US007389987B1

(12) United States Patent
Paukert

(10) Patent No.: US 7,389,987 B1
(45) Date of Patent: Jun. 24, 2008

(54) RECONFIGURABLE AIR TABLE GAME ASSEMBLY

(75) Inventor: William M. Paukert, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 156 days.

(21) Appl. No.: 11/401,584

(22) Filed: Apr. 11, 2006

(51) Int. Cl.
*A63B 67/14* (2006.01)
*A63F 7/07* (2006.01)

(52) U.S. Cl. ..... 273/108.1; 273/109; 273/118 R; 273/119 R; 273/118 A

(58) Field of Classification Search ..... 273/108.1, 273/126 R, 126 A, 127 R, 119 R, 119 A, 273/129 V, 129 W, 109; 108/7
See application file for complete search history.

(56) References Cited

U.S. PATENT DOCUMENTS 3,931,972 A * 1/1976 Fabian ..... 273/110
3,954,267 A 5/1976 Freeman et al.
4,173,341 A 11/1979 Olliges
5,029,861 A 7/1991 Driska
5,110,128 A 5/1992 Robbins
2003/0168801 A1* 9/2003 Zucchi et al. ..... 273/126 R
2005/0104294 A1* 5/2005 Chen ..... 273/309

* cited by examiner

*Primary Examiner*—Gene Kim
*Assistant Examiner*—Michael D Dennis
(74) *Attorney, Agent, or Firm*—Perry Hoffman

(57) ABSTRACT

A reconfigurable air table hockey game includes at least one air puck and is designed to be set upon a flat, horizontal surface. The game comprises a perforated, bounded playing surface overlying a plenum chamber that is supplied with air under pressure, at least during game play. A score keeping mechanism receives signals indicative of scoring events. The game includes goals suitable for air hockey game play attached to and positioned at opposite ends of the playing surface to accept an air puck and to signal to the score keeping mechanism the passage of an air puck through a goal. The game further includes a control that, when actuated, reconfigures the game to at least one new and different physical configuration such that the game is no longer suited for air hockey but is well suited for the playing of at least one other type of air table game that also utilizes one or more air pucks.

20 Claims, 18 Drawing Sheets

102
134
124
108
117
132
112
126
122
144
104
105
136
162
146
152
158
192
214
212
10
130
110
9
208
210
142
198
168
206

RECONFIGURABLE AIR TABLE GAME ASSEMBLY

BACKGROUND OF THE INVENTION

1. Field of the Invention

The invention relates generally to games where players cause game pieces to slide across horizontal playing surfaces, and more particularly to air table games where the game pieces float across the surface of a table on a thin cushion of air.

2. Description of the Related Art

Air table games are known to the prior art. For example, U.S. Pat. No. 3,954,267 (Richard Freeman, et al., issued on May 4, 1976) teaches the design of an air hockey game. The game includes a generally rectangular game table bounded by a sidewall, with two depressed goal areas positioned at opposite ends of the table. The surface of the table contains numerous regular perforations through which air flows from air conduits underneath the table. The air is forced into the conduits by a fan. A thin, circular puck, when placed upon the table's surface, floats upon a cushion of air. The players use circular hand paddles with upstanding central handles and flat bottoms to bat the puck towards the goals. The puck, driven by the paddles, bounces off the sidewall and off the paddles and moves about the surface at relatively high speed with very little frictional loss of velocity. U.S. Pat. No. 5,029,861 (John J. Driska, issued on Jul. 9, 1991) also discloses such a hockey game but also adds a small hole to the playing surface (which does not normally interfere with movement of the puck) into which a variety of obstacles may be inserted to add variety and excitement to the hockey game. Another similar game is disclosed in U.S. Pat. No. 5,110,128 (Mark J. Robbins, issued on May 5, 1992). This game also utilizes a perforated playing surface and circular pucks, but the game works more like a bowling game. Multiple targets are provided at one end of the sliding surface. The player, working from the other end of the sliding surface, slides the pucks towards the goals. As in the above hockey games, the pucks may bounce off the game's sidewalls, and the motion of the pucks is relatively free of friction.

U.S. Pat. No. 4,173,341 (William E. Olliges, issued on Nov. 6, 1979) teaches the design of an air pinball game. The game, in most respects, resembles a standard rolling-ball pinball game, with a floor-standing table supporting a glass cover through which a gently sloping playing surface can be viewed. The surface, however, contains numerous regular perforations through which air flows out of a box-like air plenum mounted beneath the surface, the air being forced into this plenum by a fan beneath the table. Instead of rolling balls, this game utilizes circular pucks that float upon the surface in a relatively friction-free manner upon a thin cushion of air. The pinball game includes bumpers both at the boundaries of the surface and also circular bumpers mounted in the central regions of the surface which, when struck by the circular pucks, light up and also signal scoring events. Flippers towards the lower end of the surface permit the player, by actuating electrical buttons, to impact the puck and drive it uphill towards the bumpers to gain scores. A display console mounted above the high end of the surface displays the score and adds to the entertainment aspects of the pinball game.

An object of the present invention is to provide an air table game such as those described above that can be reconfigured into a different air table game with very little effort on the part of a player. Another object is to design such a reconfigurable air table game so that may be disassembled for compact storage and shipment and then be reassembled with relative ease, yet that achieves a suitably smooth and rigid playing surface beneath which there lies a suitably leak-free plenum chamber.

SUMMARY OF THE INVENTION

In at least one of its described embodiments, the invention relates to a reconfigurable air table hockey game that includes at least one air puck and that is designed to be set upon a flat, horizontal surface. The game comprises a perforated, bounded playing surface overlying a plenum chamber that is supplied with air under pressure, at least during game play. A score keeping mechanism receives signals indicative of scoring events. The game includes goals suitable for air hockey game play attached to and positioned at opposite ends of the playing surface to accept an air puck and to signal to the score keeping mechanism the passage of an air puck through a goal. The game further includes a control that, when actuated, reconfigures the game to at least one new and different physical configuration such that the game is no longer suited for air hockey but is well suited for the playing of at least one other type of air table game that also utilizes one or more air pucks.

DETAILED DESCRIPTION OF THE EMBODIMENTS

A single embodiment of the invention is shown in all the drawings which present a variety of views of this one embodiment. FIGS. 1 to 11 and 13 to 17 present the game configured for air hockey, while FIG. 12 and FIGS. 18 to 28 present the game configured for air pinball, and FIGS. 2, 5, 9, and 15 are also applicable to the air pinball configuration of the game (since they show no elements which change when the game is reconfigure).

Figure 1:
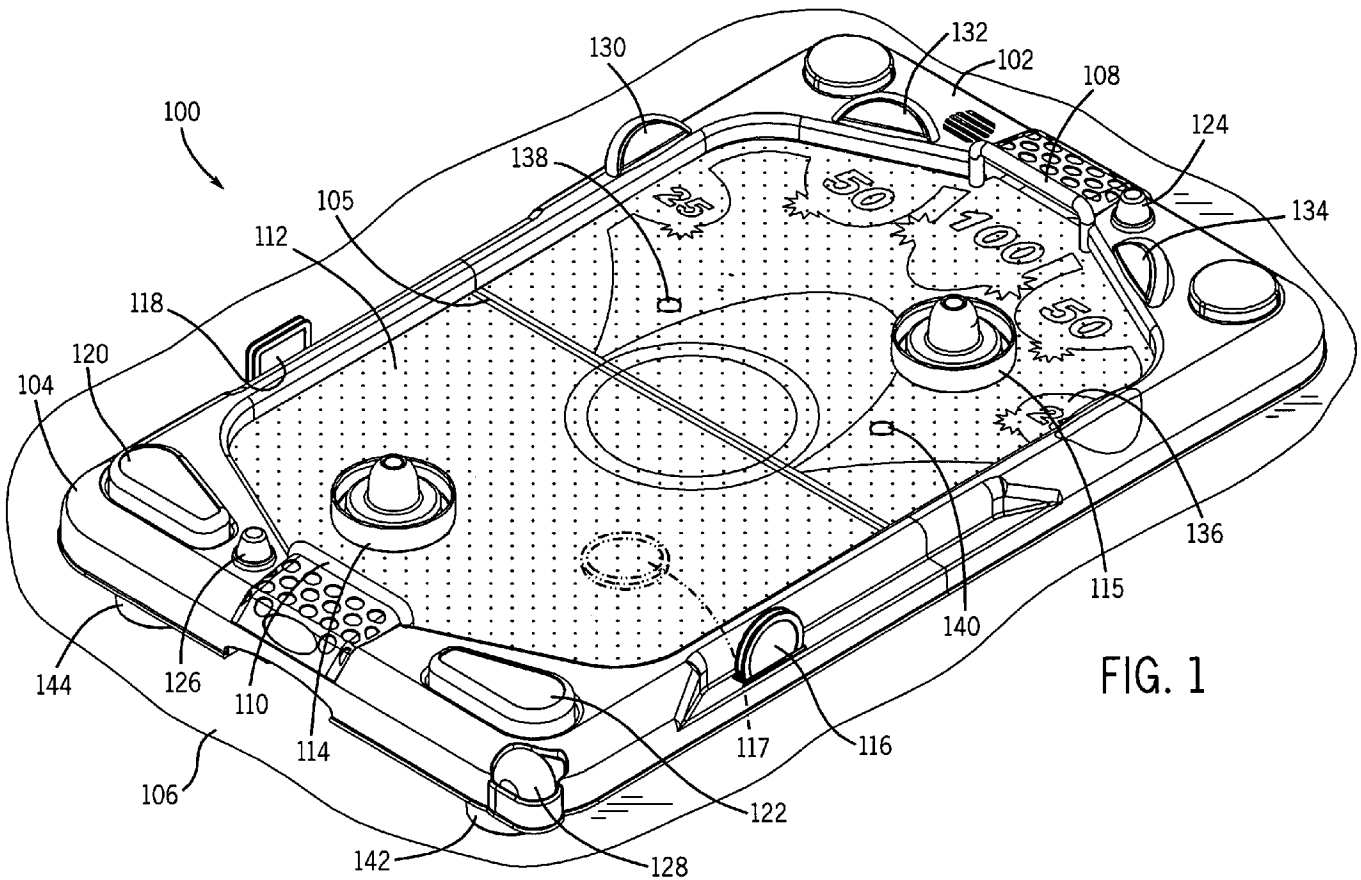
FIG. 1 presents an isometric view of an embodiment of an air hockey and pinball game, shown configured as an air hockey game, and designed in accordance with the present invention.
Figure 2:
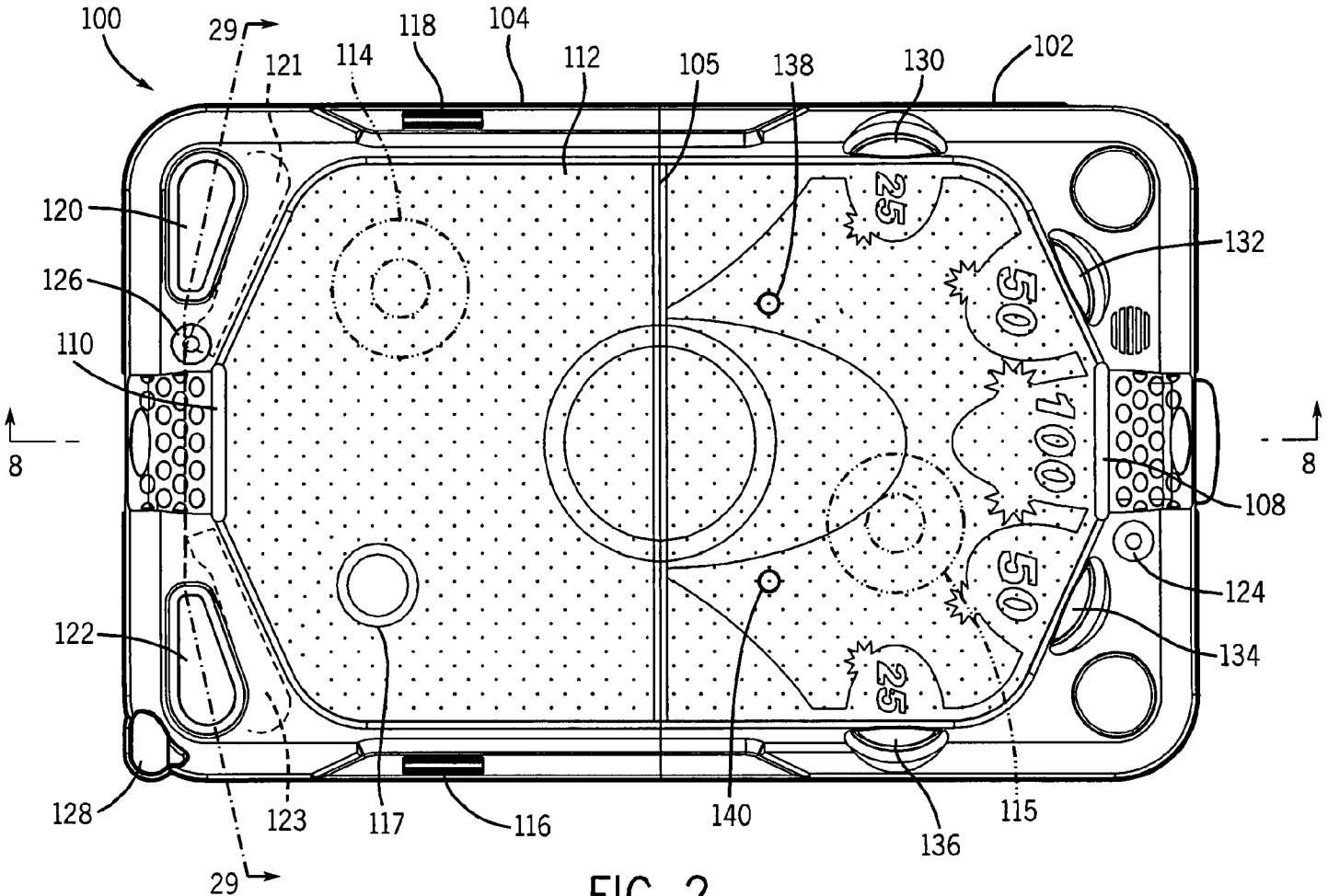
FIG. 2 is a top view of the air hockey and pinball game.
Figures 4, 7, 8:
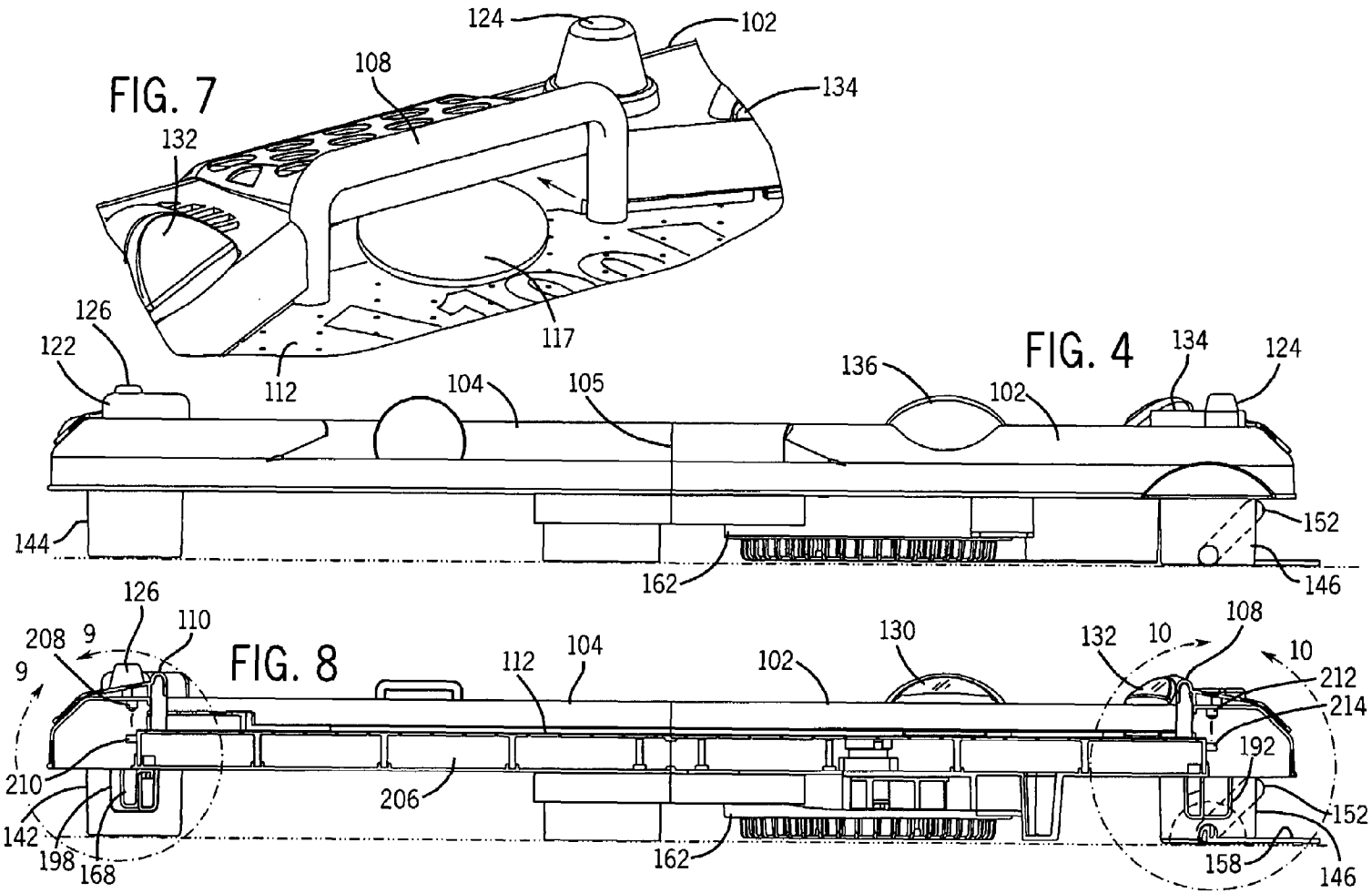
FIG. 4 is a front view of the air hockey and pinball game, configured as an air hockey game.
FIG. 7 is a perspective, close-up view of the playing surface and goal at the right end of the air hockey and air pinball game, configured as an air hockey game (compare to FIG. 26).
FIG. 8 is a side, cross-sectional view of the air hockey and pinball game, configured as a hockey game, with the section taken along the lines 8-8 in FIG. 2.
Figure 6:
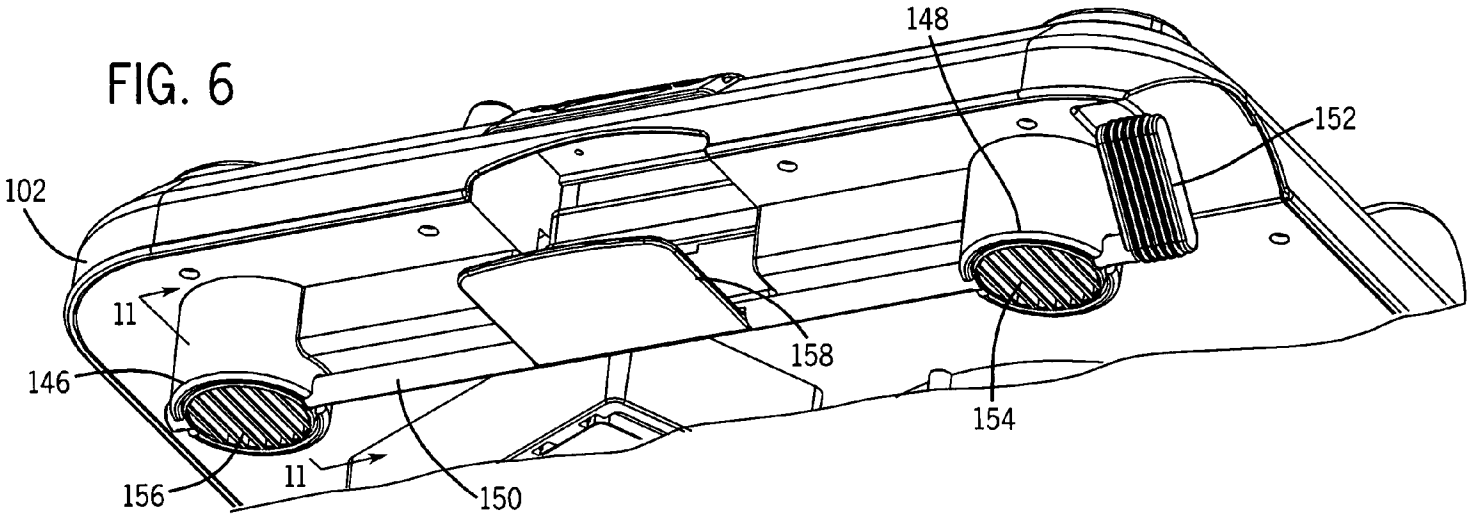
FIG. 6 presents a perspective view of the right side and bottom of the air hockey and pinball game, configured as an air hockey game, which illustrates how the right end of the game can be lowered and how the right-end goal can simultaneously be opened up when the game is transformed from an air pinball game into an air hockey game (compare to FIG. 20).
Figure 11:
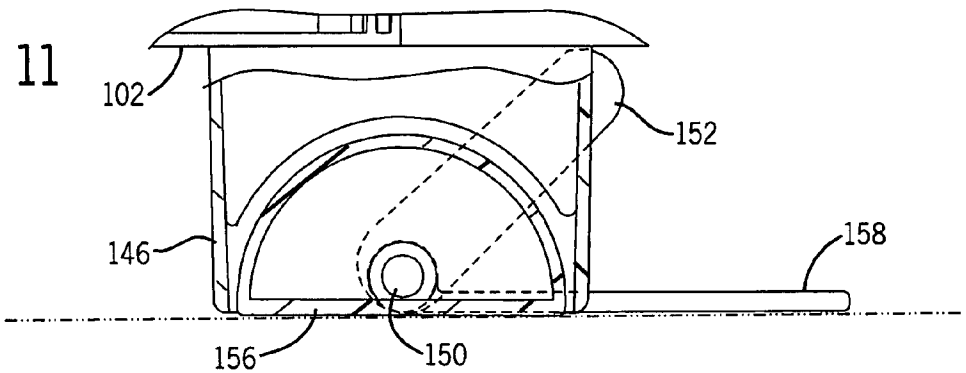
FIG. 11 is an enlarged, side, cross-sectional view of the right end of the air hockey and pinball game, configured as a hockey game, with the section taken along the lines 11-11 in FIG. 6.
Figure 18:
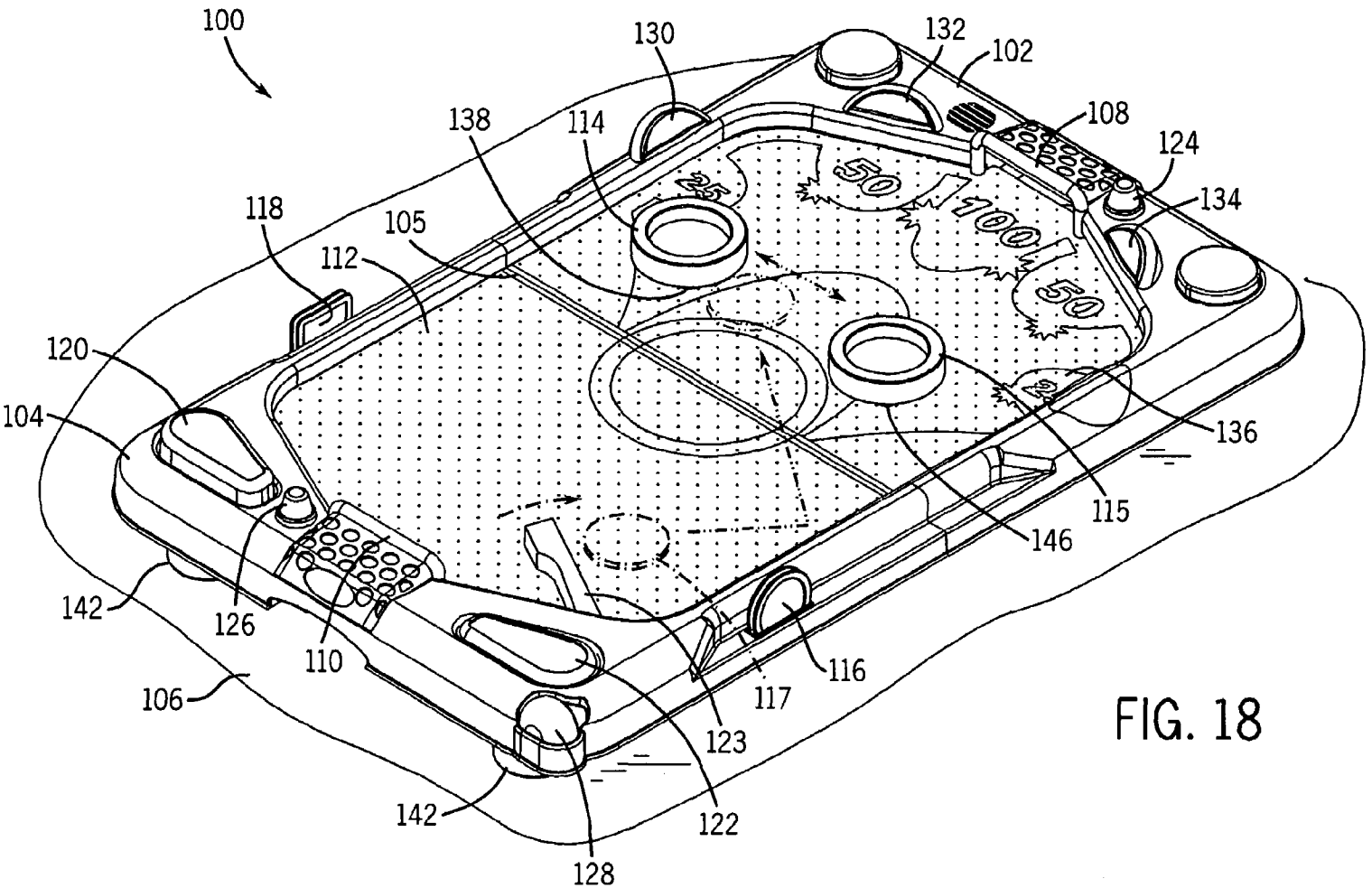
FIG. 18 presents an isometric view of an embodiment of an air hockey and pinball game, this time shown configured as an air pinball game, and designed in accordance with the present invention.
Figure 19:
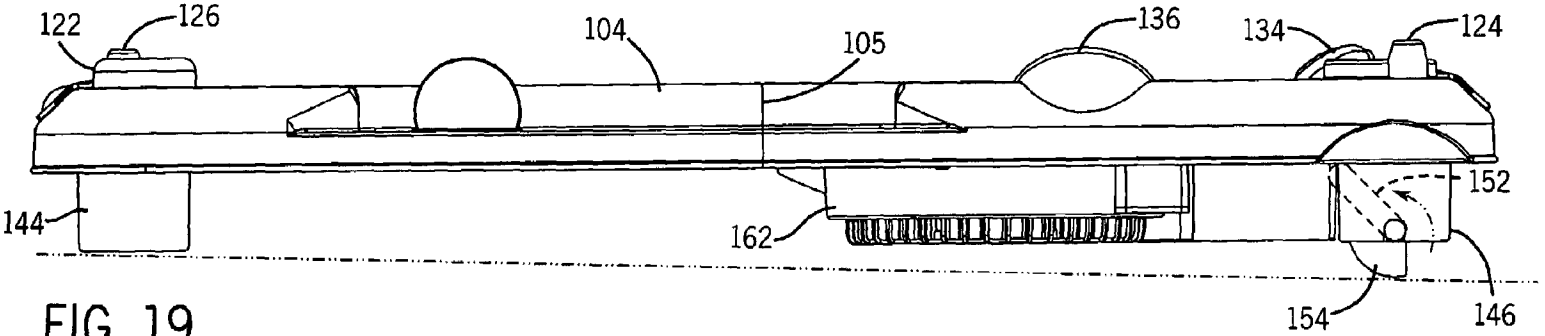
FIG. 19 is a front view of the air hockey and pinball game, configured as an air pinball game.
Figure 20:
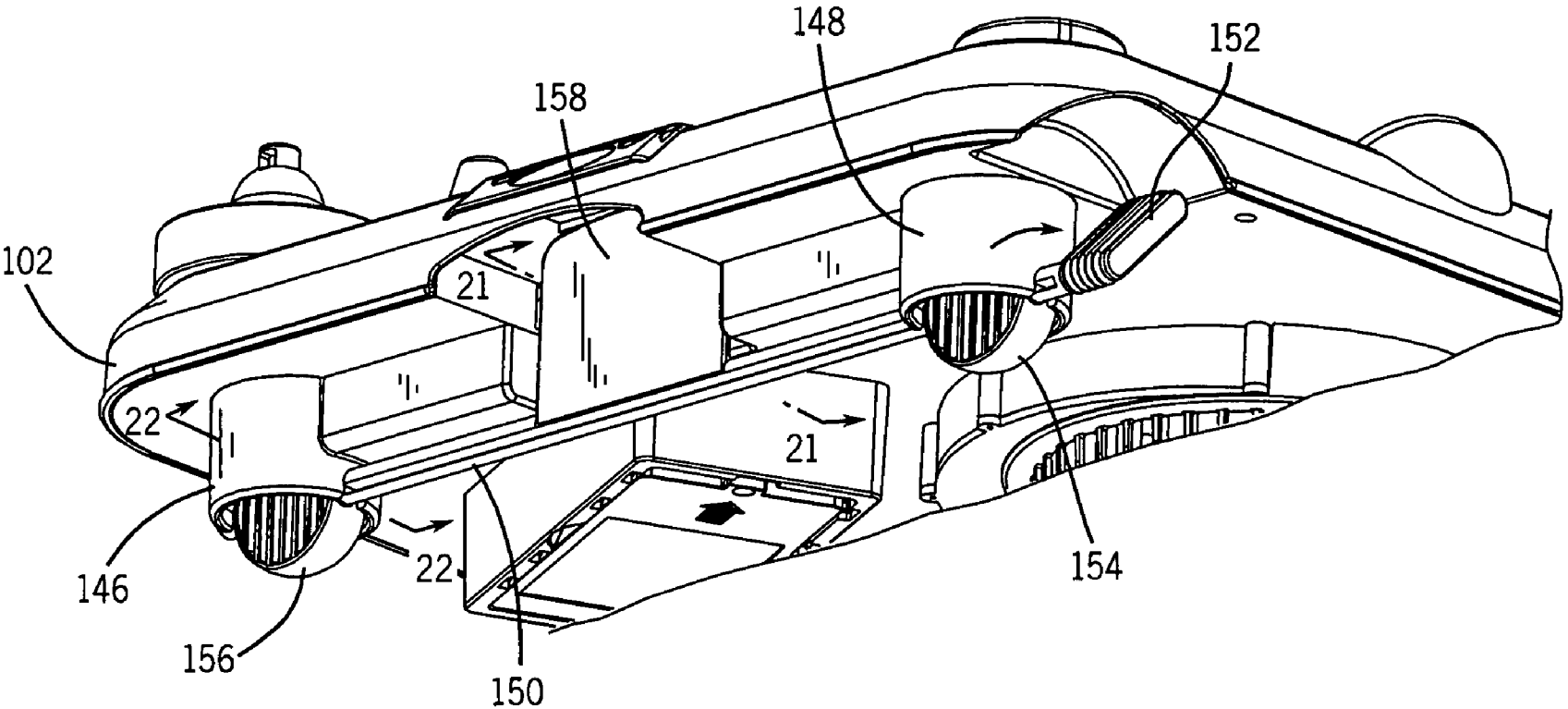
FIG. 20 presents a perspective view of the right side and bottom of the air hockey and pinball game, configured as a pinball game, which illustrates how the right end of the game can be elevated and how the right-end goal can simultaneously be blocked when the game is transformed from an air hockey game into an air pinball game (compare to FIG. 6).
Figure 24:
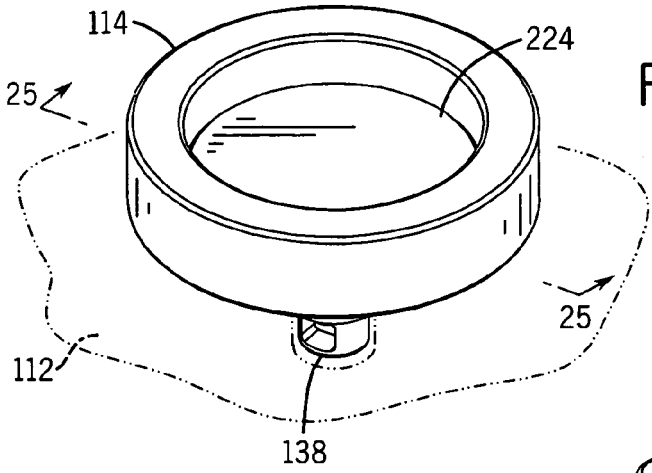
FIG. 24 is a second, perspective view of the paddle/bumper configured as a passive bumper for use in an air pinball game and shown with its lower portion mounted in a hole in the game's playing surface.
Figure 23:
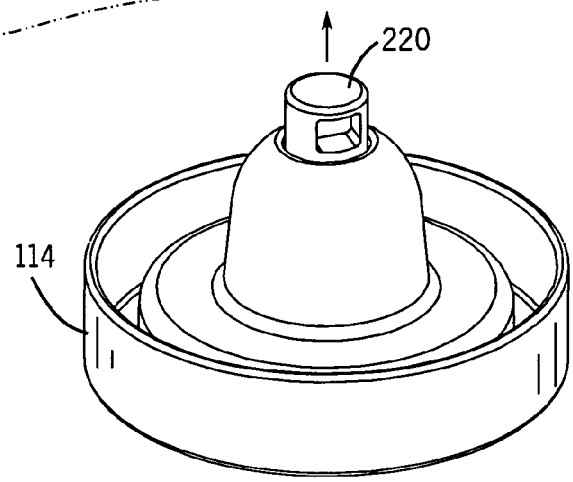
FIG. 23 is a first, perspective view of the paddle/bumper configured as a passive bumper for use in an air pinball game, but which may be transformed into a paddle for use in an air hockey game.
Figure 25:
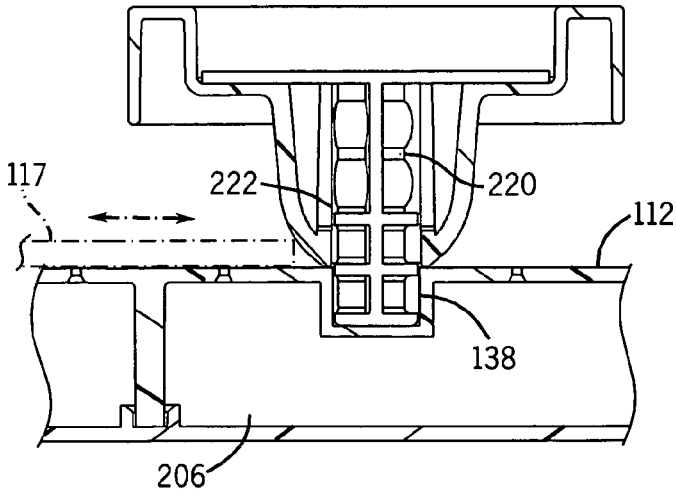
FIG. 25 is a third, side, sectional view of the paddle/bumper configured as a passive bumper and shown mounted in a hole in the game's playing surface, the section taken along the lines 25-25 in FIG. 24.
Figure 26:
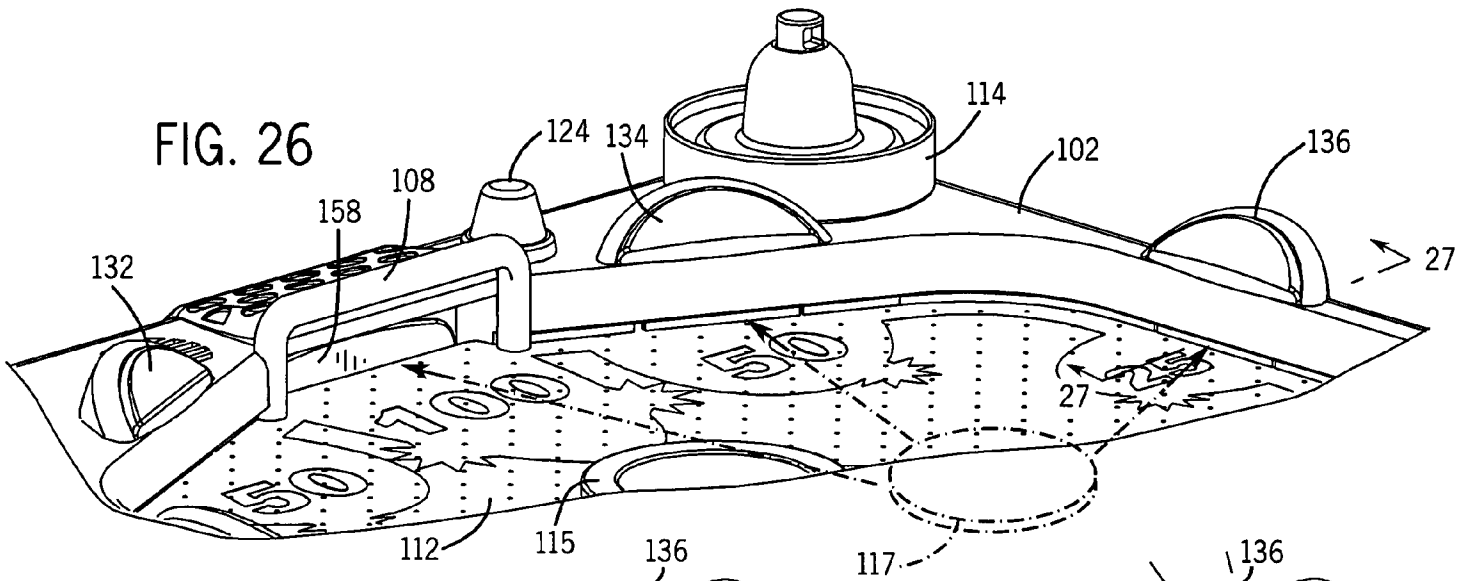
FIG. 26 is a perspective, close-up view of the playing surface, bumpers, and goal at the right end of the air hockey and air pinball game which is configured as a pinball game, illustrating how the goal is blocked and revealing the impact members that actuate scoring switches when a puck strikes a bumper (compare to FIG. 7).

An overview of the invention can be gained by comparing FIGS. 1, 6, and 7, which depict the game configured for air hockey, with FIGS. 18, 20, and 26, which depict the game configured for air pinball.

Mechanical Components of the Game

Figure 3:
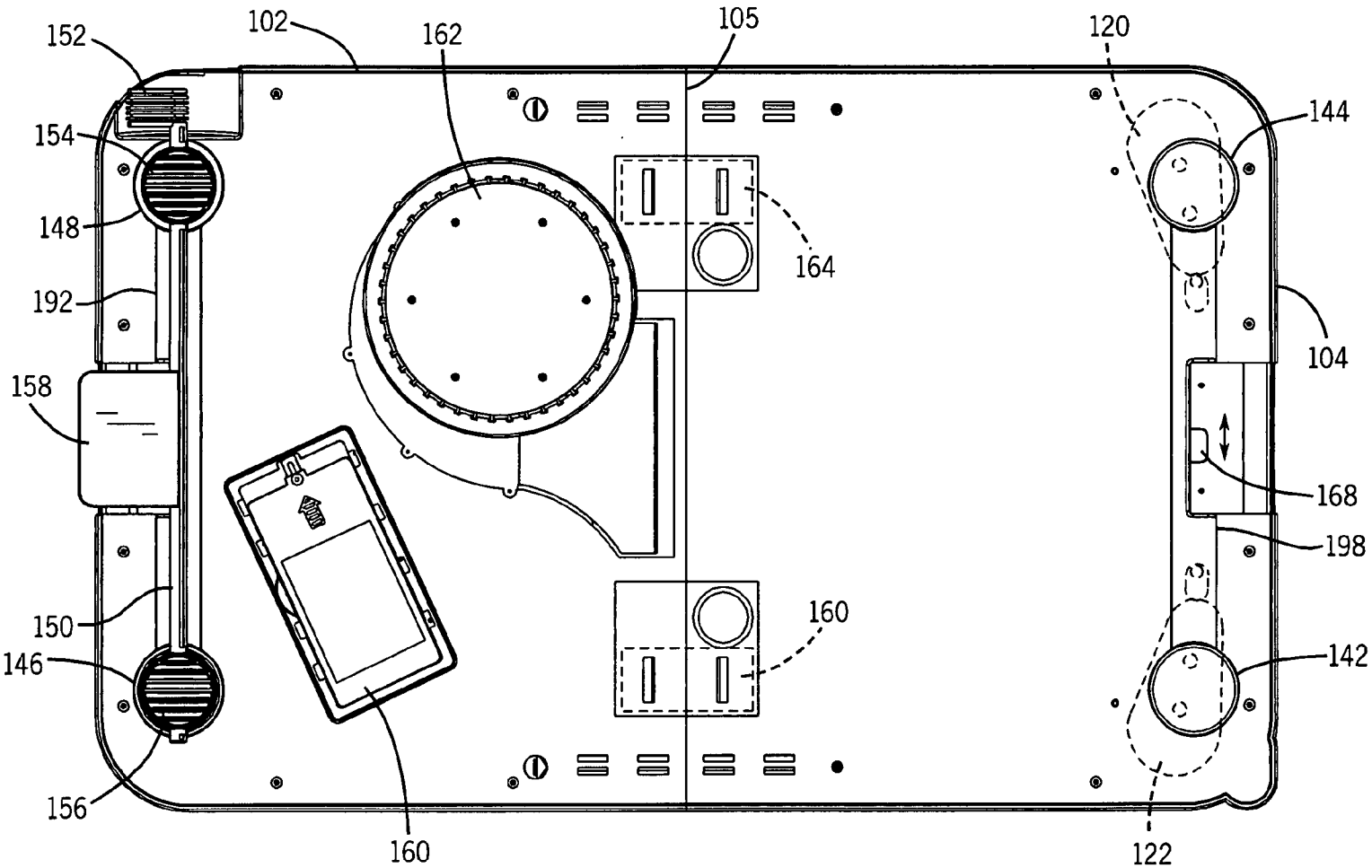
FIG. 3 is a bottom view of the air hockey and pinball game, configured as an air hockey game.

FIG. 1 presents the game 100 sitting on a horizontal surface 106 and configured for the game of air hockey. The game 100 is formed from two separable portions, an elevatable portion 102 and a flipper portion 104, which portions are joined together at the line 105. When joined together, the two separable portions 102 and 104 form a playing surface 112 which is perforated so that air may flow out and support pucks 117 for frictionless gliding across the surface 112. FIG. 3, which presents a bottom view of the game 100, shows the blower 162 which pressurizes air within a plenum chamber 206 (visible in FIG. 15) beneath the playing surface 112. A battery compartment 160 contains 4 standard batteries (not shown) that power the game 100.

The flipper portion 104 of the game 100 appears to the lower left in FIG. 1. It includes slots where the pucks 116 (round) and 118 (square with rounded corners) may optionally reside when they are not in use. It includes a first open hockey goal 110 and a goal light 126 that lights up whenever a hockey goal is scored. It also includes a pushbutton switch and light 128 that may be depressed to start the game 100 or to switch from one game configuration to another. (This pushbutton switch and light 128 is called the game's "start button" in the game's audible instructions, described below.) It includes a mechanical slide switch 168 (shown in FIG. 3—not visible in FIG. 1 because it is underneath the flipper portion 104). This mechanical slide switch 168 switches the game 100 from its air hockey configuration to its air pinball configuration, as will be explained more fully below.

The flipper portion 104 further includes the two flippers 121 and 123 (shown in FIG. 2), which are used only for pinball and thus are not shown in FIG. 1. FIG. 1 does show the two flipper pushbuttons 120 and 122 which a player depresses to actuate the flippers 121 and 123 when the game is switched to the air pinball configuration. As will be explained below, when the game is in air hockey configuration, the flipper buttons 120 and 122 are locked and thus may not be depressed—they are unable to flip out and interfere with the hockey game. Each of the flipper buttons 120 and 122 has extending downwards from its lower surface a threaded screw with a very wide thread pitch (not shown) that engages a similarly-threaded hole (not shown) on the corresponding one of the two flippers 121 and 123. Accordingly, when one of the flipper buttons 120 or 122 is depressed, the threads cause the corresponding flipper 121 or 123 to swing outwards and strike (or miss) the puck 117. When a flipper button 120 or 122 is released, a spring returns the flipper button 120 or 122 to its rest position. The corresponding flipper 121 or 123 is forced back up the screw to its starting position during this process.

The flipper portion 104 rests on two non-elevatable feet 142 and 144 which keep the left (flipper) end of the game 100 a fixed height above the horizontal surface 106.

The elevatable portion 102 of the game 100 appears in the upper right portion of FIG. 1. It also includes a goal 108 and a goal light 124, but the goal 108 is blocked when the game is configured for air pinball, as will be explained below. A comparison of FIG. 1, where the game is configured for air hockey, with FIG. 18, where the game is configured for air pinball, reveals that with respect to the horizontal surface 106, the elevatable portion 102 is slightly elevated in FIG. 18 (with respect to the flipper portion 104) to tilt the playing surface 112 slightly and thereby to cause the puck 117 to slide to the left towards the flippers 121 and 123 and towards the goal 110, which serves as an exit for pucks 117 from the air pinball game. In FIG. 1, the playing surface is level, and there is no tilt to cause the puck 117 to go preferentially towards either goal, as is essential for an air hockey game.

The elevatable portion 102 is also shown from underneath in FIG. 6, where it is shown lowered for air hockey, and in FIG. 20, where it is shown elevated for air pinball. A handle 152, which a player may rotate from the non-elevated position shown in FIG. 6 to the elevated position in FIG. 20, rotates an elevation adjusting shaft 150 which causes a pair of rotatable hemispheres 154 and 156 to rotate 90 degrees, either raising or lowering the elevatable portion 102 by extending its feet 146 and 148. A comparison of FIGS. 6 and 20 further reveals that the shaft 150 also rotates a goal barrier 158 into position blocking the goal 108 when the game is air pinball. When the game is air hockey, the shaft 150 rotates the goal barrier 158 downwards so as not to block the goal 158.

The elevational portion 102 also includes four illuminated pinball bumpers 130, 132, 134, and 136 which play no part in an air hockey game, when the goal of the game is to shoot the puck through one or the other of the two goals 108 and 110. When the game is configured for air pinball, lights within the bumpers 130 to 136 and also the goal light 124 light up whenever a puck strikes one of the bumpers 130 to 136 or the goal 108. The goal 108 is blocked by the goal barrier 158 so that the goal 108 functions just as if it were a fifth illuminated bumper.

When the game 100 is configured for air hockey, as shown in FIG. 1, two paddle/bumpers 114 and 115 are configured as paddles (see FIGS. 16 and 17) and may be used by two players, as is shown in FIG. 1, to strike at the puck 117, with each player trying to send the puck 117 through to the other player's goal 108 or 110. When the game is configured for air pinball, as shown in FIG. 18, optionally the two paddle/bumpers may be adjusted and turned upside down to form passive pinball bumpers. To transform a paddle into a bumper, the shaft 220 is extended from the cylindrical hole 222 by pressure applied to the opposite surface 224. The paddle is then turned upside down and is inserted into one of two passive bumper mounting holes 138 and 140 in the playing surface 112. This adjustment is from the configuration shown in FIGS. 16 and 18 (configured for use as paddles during air hockey) to the configuration shown in FIGS. 23, 24, and 25 (configured for use as passive bumpers during air pinball). As is shown in FIG. 18, the two paddle/bumpers 114 and 115 become passive bumpers on the playing surface 112 of the air pinball game 100 and cause the puck 117 to bounce around more. Different numbers and shapes of bumpers can be employed, and the bumpers can alternatively be designed to move and thus alter the movement of the puck 117. These bumpers also can be equipped with lights and puck-sensing switches similar to those found on the four bumpers 130-136 so that striking the bumpers can add to a player's score.

Figure 10:
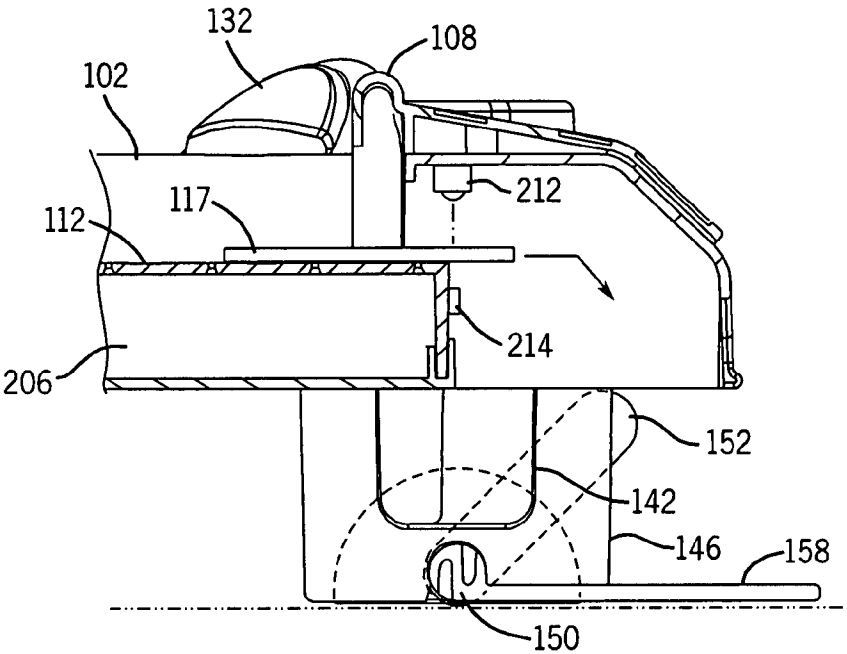
FIG. 10 is an enlarged, side, cross-sectional view of the right end of the air hockey and pinball game, configured as a hockey game, with the section taken along the lines 10-10 in FIG. 8.
Figure 9:
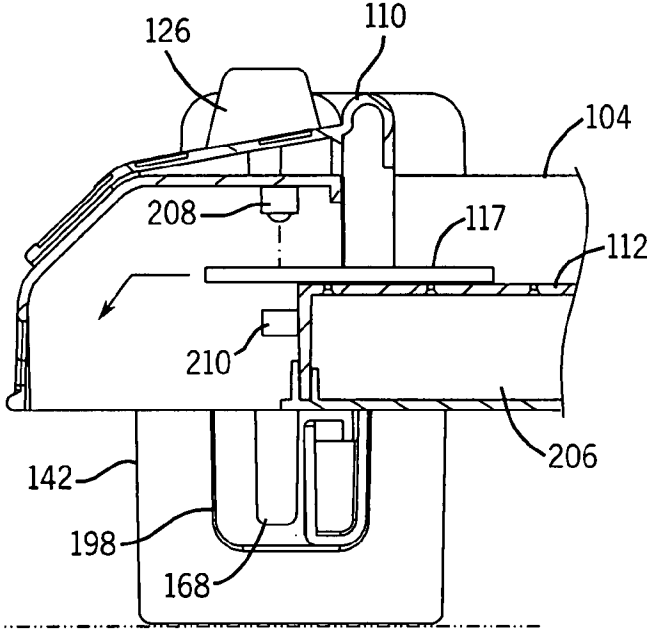
FIG. 9 is an enlarged, side, cross-sectional view of the left end of the air hockey and pinball game, with the section taken along the lines 9-9 in FIG. 8.

When the game 100 is in air hockey configuration, FIGS. 9 and 10 illustrate how the goals 108 and 110 function. As can be seen, the puck 117 is free to slide right through either goal 108 and 110 and to fall out of the game 100 onto the horizontal surface 106 that supports the game 100.

As a puck 117 passes through the goal 108, it cuts the path over which red light flows between a light emitting diode or LED 212 and a phototransistor 214. A signal emitted by the phototransistor 214 is then amplified by a transistor 330 and passed on to the game 100's microprocessor 302 (see FIG. 33) which responds by registering the goal and also turning on the goal light 124, which is a red LED. The microprocessor 302 may also make an appropriate noise (voice, music, cheers, etc.) to signal the goal.

Likewise, as a puck 117 passes through the goal 110, it cuts the path over which red light flows between a light emitting diode or LED 208 and a phototransistor 210. A signal emitted by the phototransistor 210 is then amplified by a transistor 328 and passed on to the game 100's microprocessor 302 (see FIG. 33) which responds as it did to a puck passing through the goal 108, except it registers the score to the other player.

Figure 5:
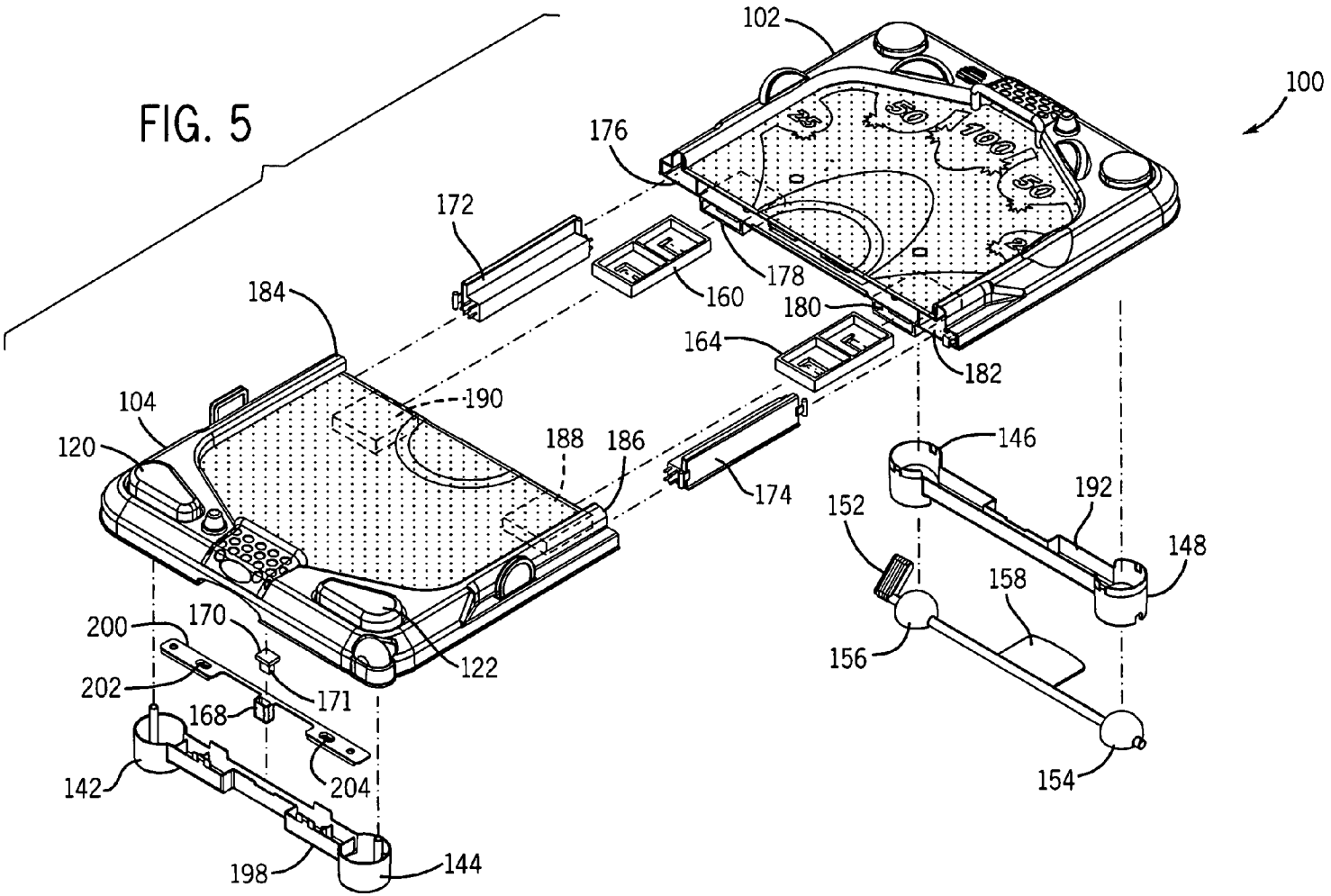
FIG. 5 is an exploded, isometric view of the air hockey and pinball game.

With reference to FIG. 5, the game 100 is shown in an exploded view which illustrates how it is assembled from its component parts.

The elevatable portion 102 and the flipper portion 104 have corresponding orifices 176, 178, 180, and 182 (on the portion 102) and 184, 190, 188, and 186 (on the portion 104). Four stiffening members 172, 166, 164, and 174 are inserted into the corresponding ones of these orifices on both of the portions 102 and 104, as shown in FIG. 5, and the two portions are pushed firmly together. Two cam locks (not shown) hold the assembly firmly together. The stiffening members 172 and 174 may optionally be provided with electrical contacts, as shown, which engage mating electrical contacts (not shown) within the orifices 176, 182, 184, and 186 and which thereby connect the electrical and electronic elements of the game positioned in the two portions 102 and 104 together. The portion 104 contains the pushbutton switch and light 128 (FIG. 1), the goal light 126 (FIG. 1), a light-emitting diode 208 and phototransistor 210 (associated with the goal 110—see FIG. 8), and an electrical slide switch 170 (explained below). By studying the circuit diagram 300 presented in FIG. 33, it can be seen that eight wires are required leading from the portion 102 to the portion 104: a ground wire, a $V_{DD}$ (+4.5 volt) wire, two wires leading to the light and switch components of the light and switch 128 (these components being separately labelled in FIG. 33 as light emitting diode 128D and switch 128S), and individual wires leading to the slide switch 170, the goal light 126, the goal light emitting diode 208, and the goal phototransistor 210. Hence, four wires are conveyed through each of the stiffening members 172 and 174, as is shown in the various Figures.

FIG. 5 reveals that the elevatable portion 102 has snapped onto its underside an elevatable base 192 having two elevatable feet 146 and 148 which support the elevation adjusting shaft 150 and which connects to the shaft 150's rotatable hemispheres 154 and 156. These, and their function in raising the portion 102 of the game 100 for air pinball and lowering that portion 102 for air hockey, were described above in the discussion of FIGS. 6 and 20.

FIG. 5 also reveals that the flipper portion 104 has snapped onto its underside a non-elevatable base 198 that includes the two non-elevatable feet 142 and 144. As is shown in FIG. 5, a slidable flipper button locking rod 200 is locked in between the base 198 and the portion 104 in such a manner that it is free to slide sideways (this will be explained more fully in the discussion presented below of FIGS. 12 to 14 and 29 to 32). Positioned above this locking rod 200 and mounted on the underside of the flipper portion 104 is an electrical slide switch 170 which has a slidable member 171 that engages and sticks into the hollow, finger-actuatable, mechanical slide switch 168 that is attached to the slidable locking rod 200.

A game participant may manually push the finger-actuatable, mechanical slide switch 168 in one direction (left) to lock (mechanically) the flipper buttons 120 and 122 to prepare for an air hockey game; and the mechanical slide switch 168 simultaneously pushes the slidable member 171 of the electrical slide switch 170 in that same direction, thereby informing the game's microprocessor 302 (FIG. 33) that the current game is air hockey.

A game participant may later on manually push the finger-actuatable mechanical slide switch 168 in the other direction (right) to unlock (mechanically) the flipper buttons 120 and 122 to prepare for an air pinball game, and the mechanical slide switch 168 simultaneously pushes the slidable member 171 of the electrical slide switch 170 in that same direction, thereby informing the game's microprocessor 302 that the current game is air ping pong. In this simple manner, the microprocessor 302 is able to sense which game the game participant wishes to play and to then program all the game switches and lights and sounds accordingly.

Once the game 100 is assembled, a player wishing to play an air pinball game simply slides the slide switch 168 to the right to unlock the flippers 121 and 123 and to signal the microprocessor 302 to program the game 100 for several different games of air pinball; and then the player actuates the handle 152 to block the goal 108 and to rotate the hemispheres 146 and 148 out of the feet 146 and 148 so that they elevate the right end of the game 100, tilting the playing surface for air pinball. A player later wishing to play an air hockey game simply slides the slide switch 168 to the left to lock the flippers 121 and 123 and to signal the microprocessor 302 to program the game 100 for several different games of air hockey; and then the player actuates the handle 152 in the opposite direction to open up the goal 108 and to level the playing surface 112 once again by rotating the hemispheres 146 and 148 back into the feet 146 and 148.

A game is started by depressing the pushbutton switch and light 128. The first push of the pushbutton switch and light 128 selects a first game, and subsequent pushes select different games. The cycle of games presented will vary depending upon whether the mechanical slide witch 168 has programmed the game 100 to present only air hockey games or to present only air pinball games.

Figure 28:
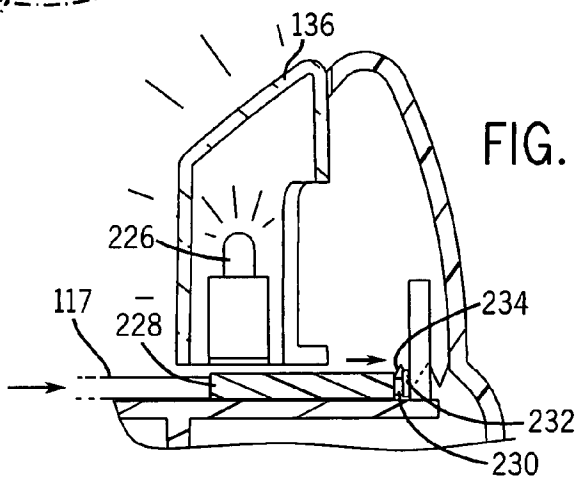
FIG. 28 is an enlarged, left side, cross-sectional view of a typical pinball bumper assembly, taken along the lines 27-27 in FIG. 26, illustrating the closed contacts of the bumper switch in the position that the contacts occupy when a puck is present and striking the impact member of the switch.
Figure 27:
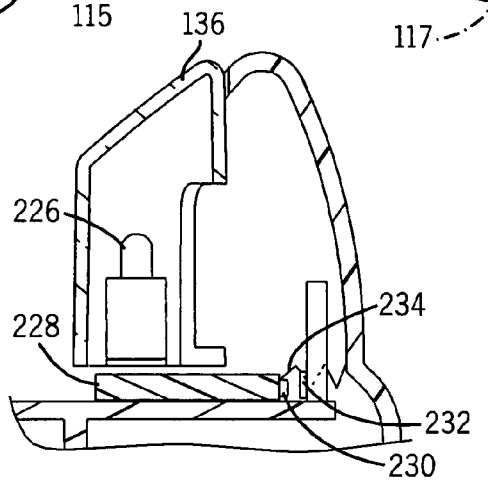
FIG. 27 is an enlarged, left side, cross-sectional view of a typical pinball bumper assembly, taken along the lines 27-27 in FIG. 26, illustrating the light emitting diode which the bumper contains as well as the open contacts of a bumper switch shown in the position that the contacts occupy when no puck is present.
Figure 29:
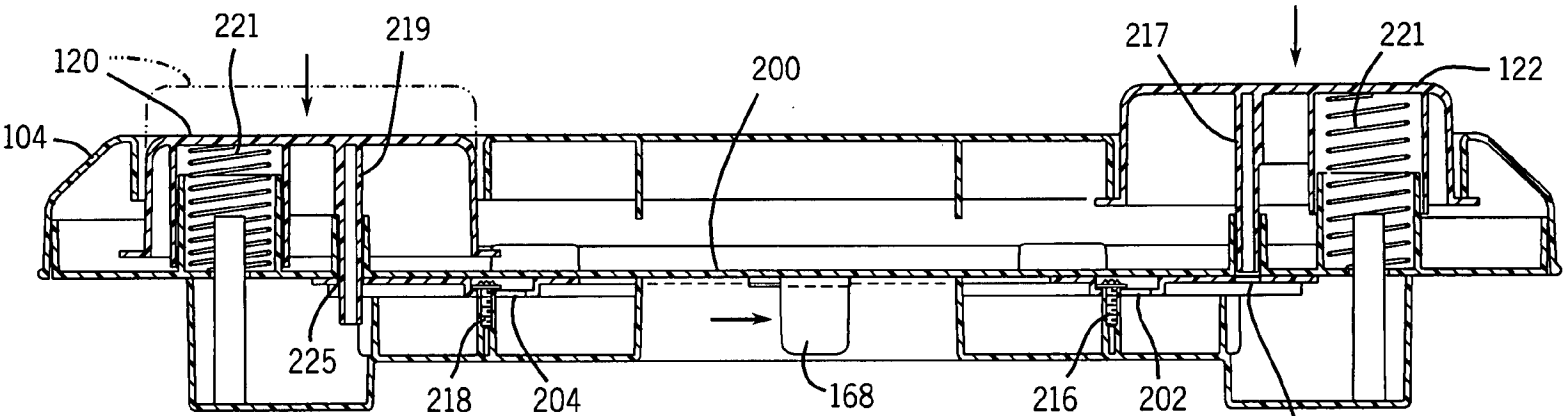
FIG. 29 is a front, sectional view, the section taken along the lines 29-29 in FIG. 2, revealing the way in which the slidable flipper locking rod 200, shifted to the right, releases the two flipper buttons 120 and 122 when the game is configured for air pinball.

FIGS. 26, 27, and 28 present additional details concerning the operation of the game 100 when it is in air pinball configuration. FIG. 26 focuses upon the right-hand, elevatable portion 102 of the game 100, and in particular upon the goal 108, the goal light 124, and the four illuminatable bumpers 130 (the bumper 130 is not shown in FIG. 26), 132, 134, and 136. FIGS. 27 and 28 each present a cross-sectional view of the illuminatable bumper 136, revealing its inner details when it is at rest (FIG. 27) and also when a puck 117 strikes it (FIG. 28).

Figure 33:
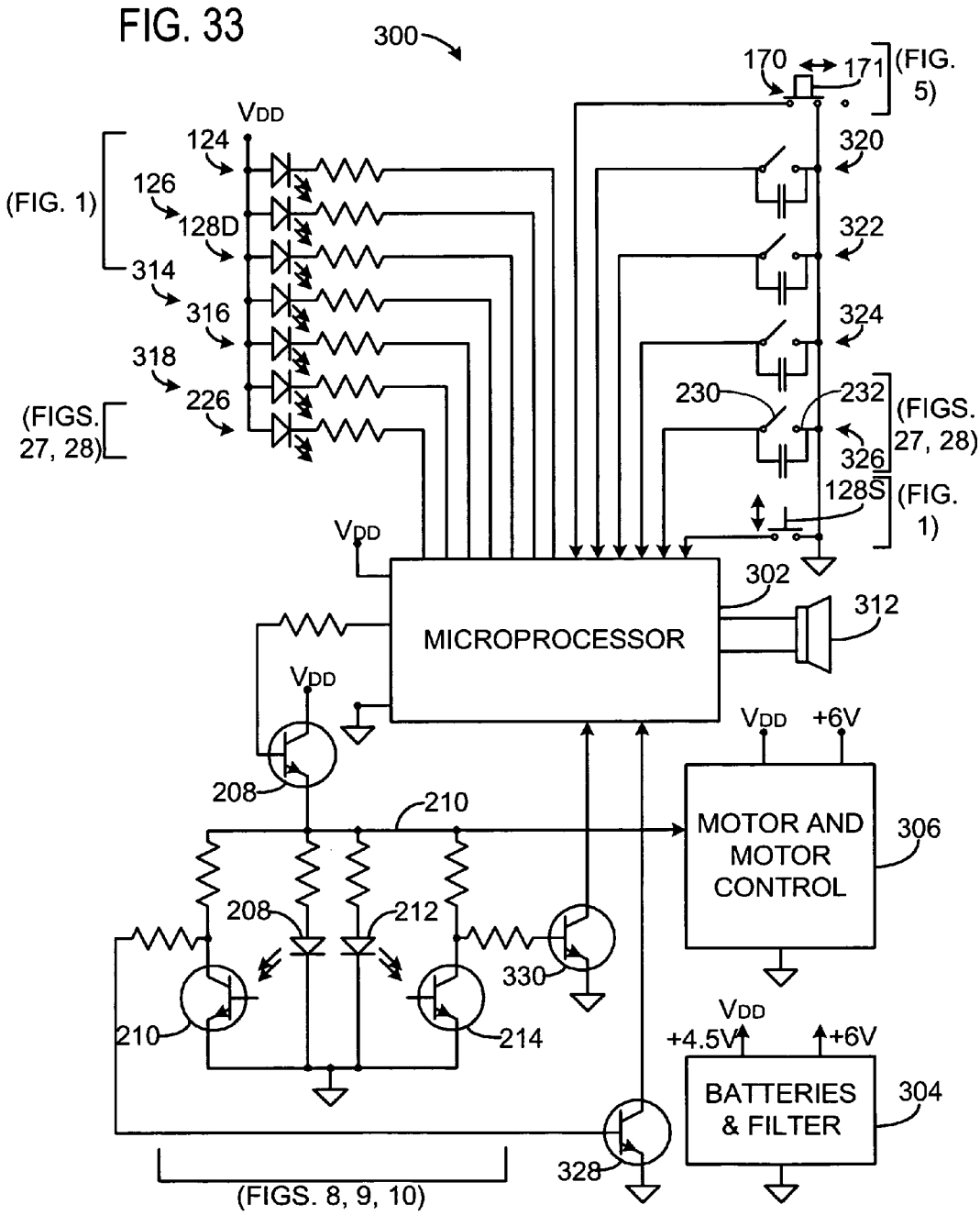
FIG. 33 is a partly logical, partly schematic diagram of the electrical and electronic components of the air hockey and pinball game, including the microprocessor, with cross-references to other figures where some of the electrical switches and lights appear.

With reference to FIG. 1, the goal lights 124 and 126 are actually red light emitting diodes or LEDs (this is shown in FIG. 33). The bumper 130 contains a yellow LED 314 (shown in FIG. 33); the bumper lights 132 and 134 contain green LEDs 316 and 318 (shown in FIG. 33); and the bumper light 136 contains a yellow LED 226 (shown in FIGS. 27, 28, and 33).

When the game 100 is in air pinball configuration, if a puck strikes the goal barrier 158 of the goal 108 or strikes an impact member 228 (FIGS. 27 and 28) is associated with one of the bumpers 130 to 136, the corresponding goal light or bumper light goes on, and a score is registered. Depending upon the specifics of the game programming (described below), different sounds or musical effects may be associated with the striking of this goal or one of these bumpers.

Each of the illuminated bumpers is constructed in the same manner as the illustrative bumper 136 shown in cross-section in FIGS. 27 and 28. In FIG. 27, the bumper 136 is seen to contain a yellow LED 226 that is controlled by the microprocessor 302 (see FIG. 33). Electrical contacts 230 and 232 (collectively referred to as switch contacts 326 in FIG. 33) are shown open in FIG. 27 (and also in FIG. 33). This is the normal state of these contacts, which are held open by a spring 234. The contact 232 is held stationary, and the contact 230 is mounted upon or attached to an impact member 228, as is shown in FIG. 27. In FIG. 28, a puck 117 strikes the impact member 228, forcing the contacts 230 and 232 into closure. As is shown in FIG. 33, this causes current to flow to the microprocessor 302 which then illuminates the LED 226, causing it to flash, and also produces (through a speaker 312 shown in FIG. 33) an appropriate sound or voice message to signal a score. The remaining three bumpers contain the LEDs 314, 316, and 318 and the switch contacts 320, 322, and 324.

Figure 21:
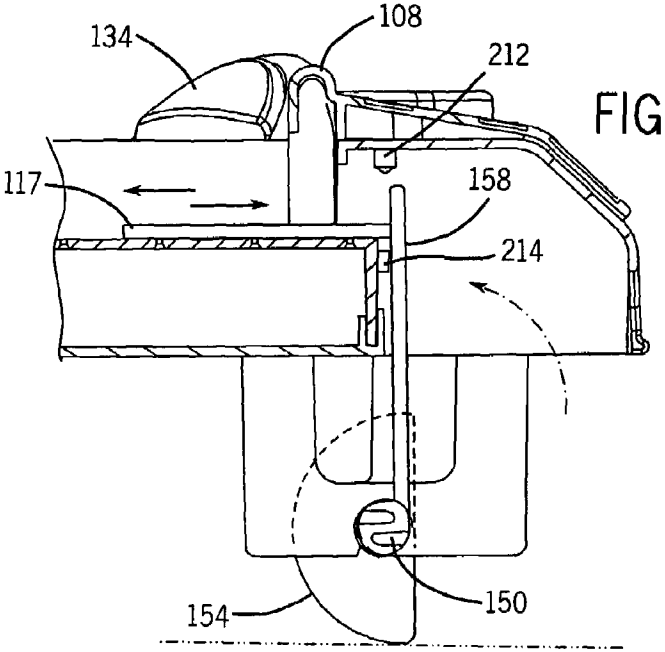
FIG. 21 is an enlarged, side, cross-sectional view of the right end of the air hockey and pinball game, configured as a pinball game, with the section taken along the lines 21-21 in FIG. 20.
Figure 22:
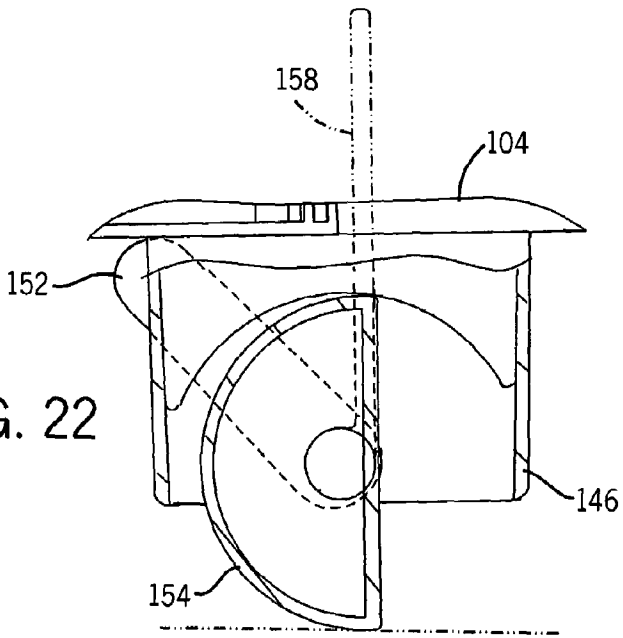
FIG. 22 is an enlarged, side, cross-sectional view of the right end of the air hockey and pinball game, configured as a pinball game, with the section taken along the lines 22-22 in FIG. 20.

The goal 108 functions similarly. With reference to FIGS. 21 and 26, whenever a puck 117 bounces off of the goal barrier 158 which closes off the goal 108 during air pinball games, the puck 117 cuts the path of red light passing from an LED 212 to a phototransistor 210 (both shown in FIG. 21) and a signal from the phototransistor 214 is amplified by the transistor 330 and flows into the microprocessor 302, which illuminates the goal light 124 and produces an appropriate sound.

Figure 14:
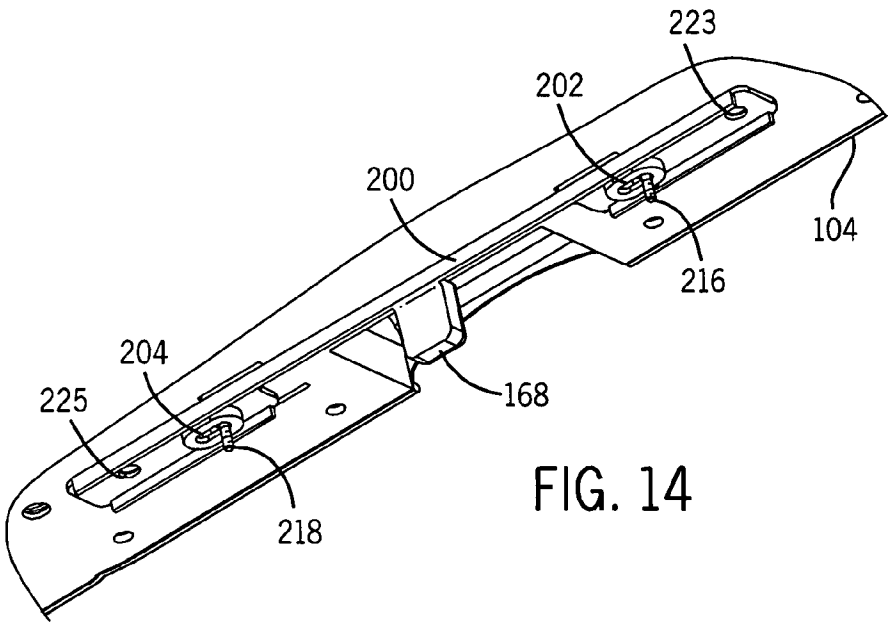
FIG. 14 is a third, isometric bottom view having the base 198 removed, the view looking up from below towards the flopper button locking rod which is shown in position to unlock the flipper buttons during an air pinball game.
Figure 13:
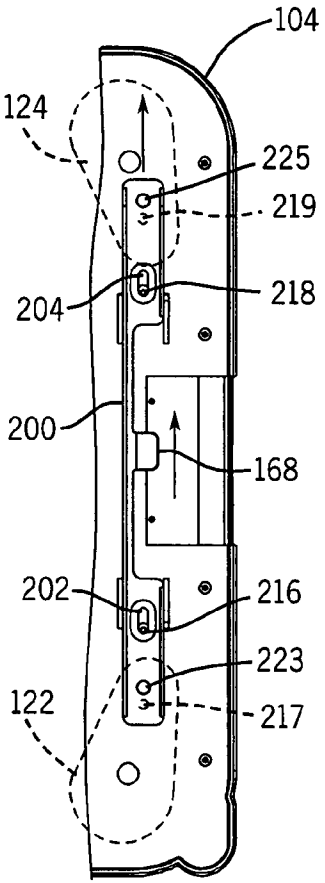
FIG. 13 is a second enlarged, bottom view of the left side of the air hockey and pinball game having the base 198 removed to reveal the flipper button locking rod which is shown in position to lock the flipper buttons during an air hockey game.
Figure 12:
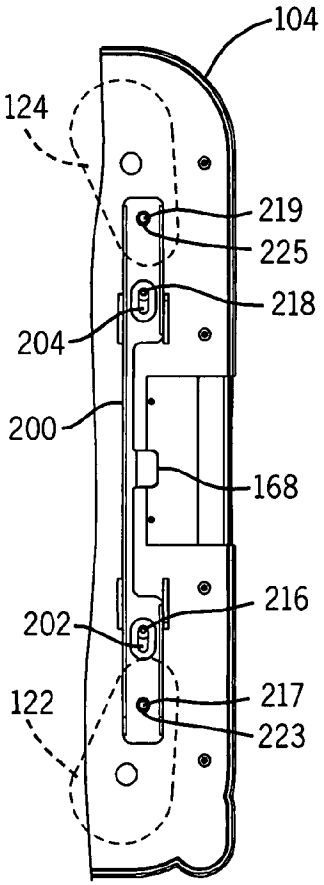
FIG. 12 is a first enlarged, bottom view of the left side of the air hockey and pinball game having the base 198 removed to reveal the flipper button locking rod which is shown in position to unlock the flipper buttons during an air pinball game.
Figure 15:
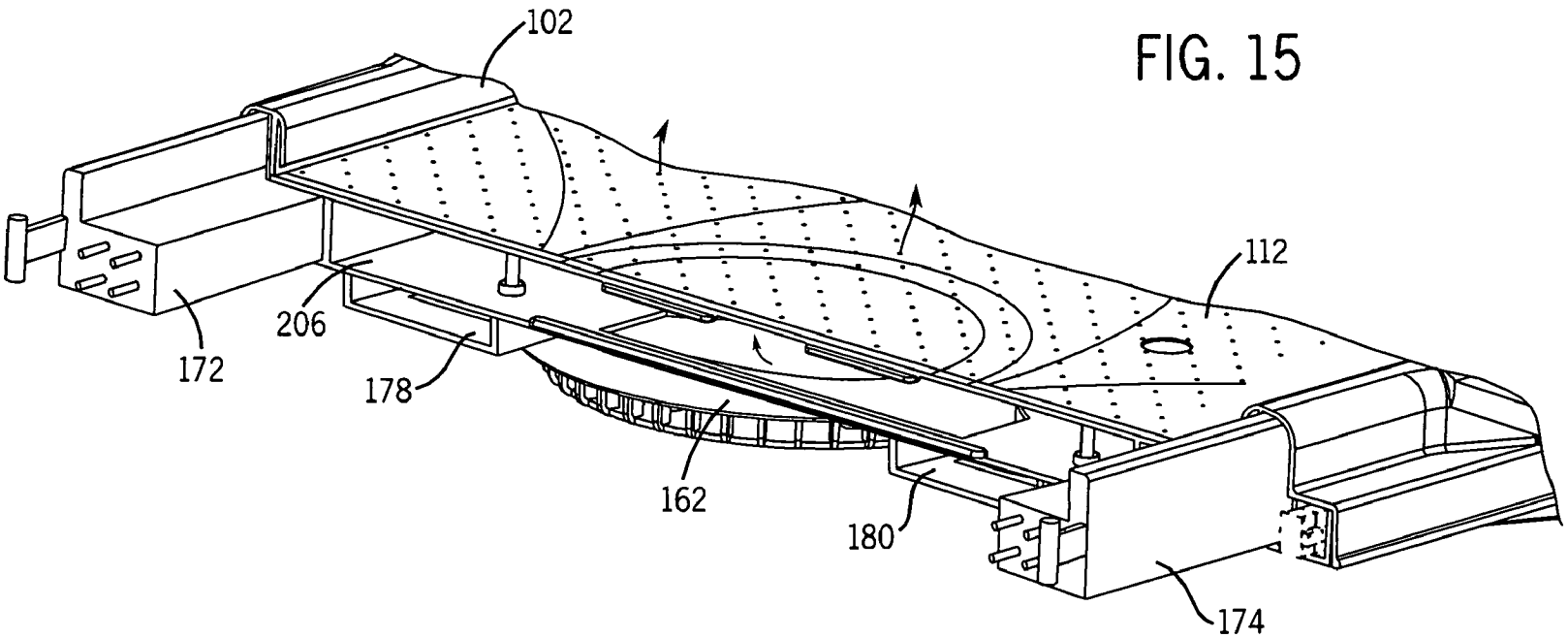
FIG. 15 is an enlarged, perspective view of the right half portion of the air hockey and pinball game that illustrates the arrangement of two stiffening members and orifices for two additional stiffening members which hold the game together and keep the playing surface rigid and level while minimizing plenum leaks.
Figure 16:
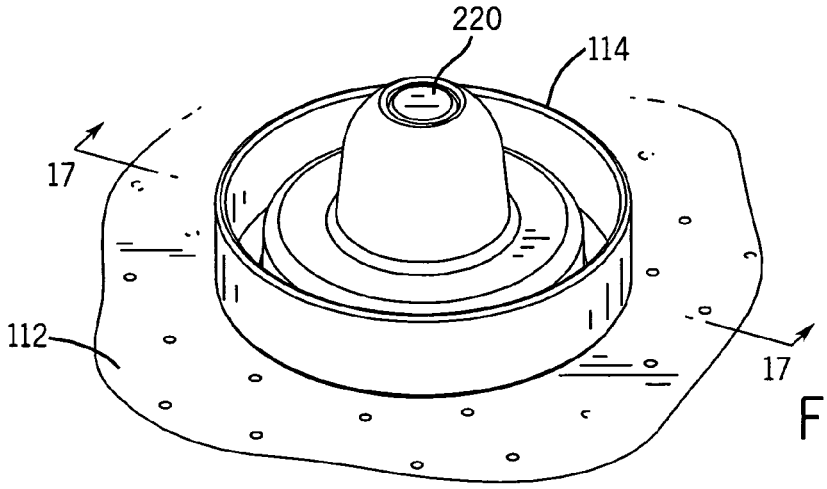
FIG. 16 is a perspective view of a paddle/bumper configured as a paddle for an air hockey game, but which may be transformed into a passive bumper for use in an air pinball game, the paddle shown positioned on the game surface.
Figure 17:
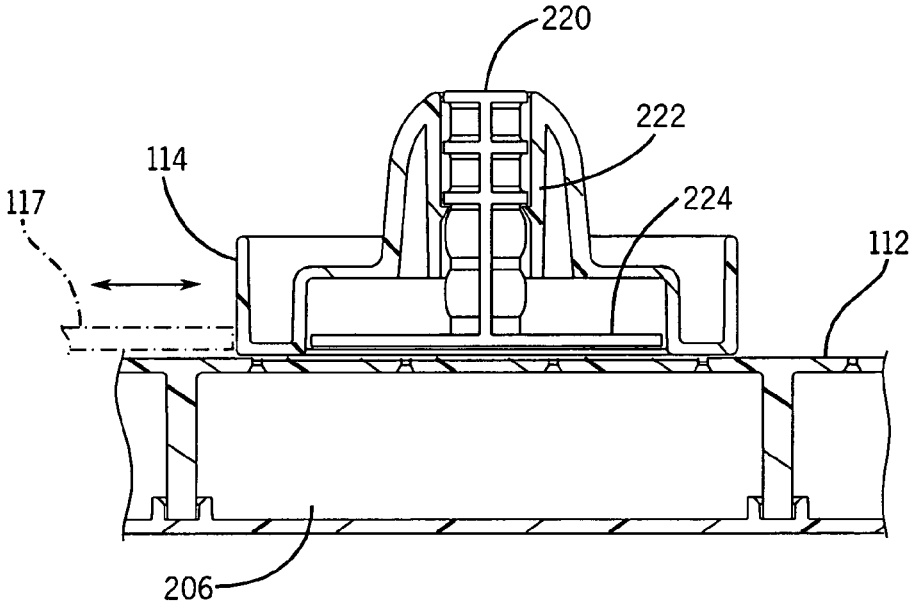
FIG. 17 is a side, sectional view of the paddle, the section taken along the lines 17-17 in FIG. 16.
Figure 30:
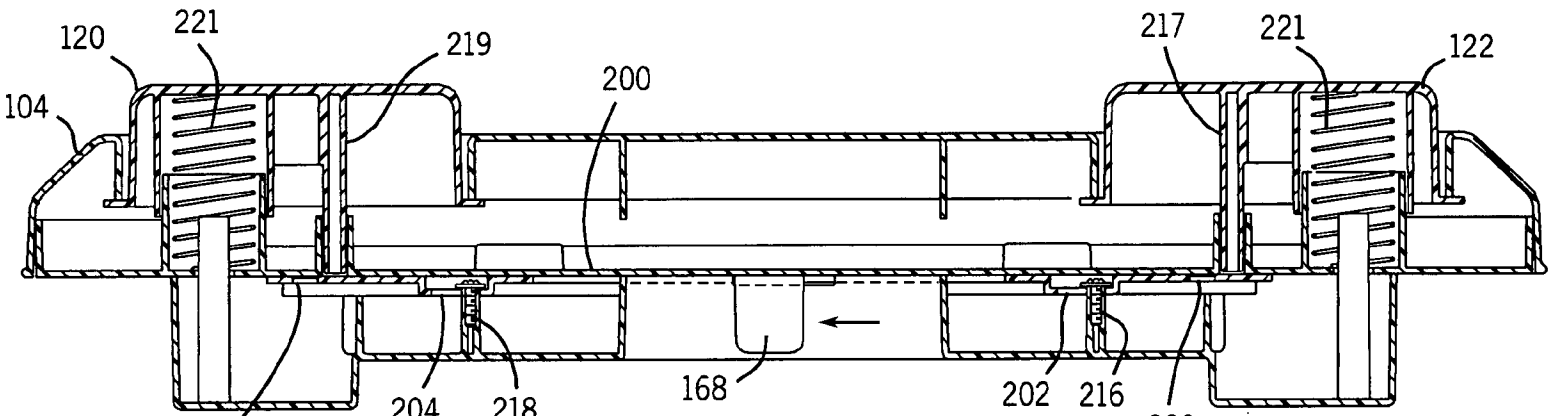
FIG. 30 is also a front, sectional view, the section taken along the lines 29-29 in FIG. 2, revealing the way in which the slidable flipper locking rod 200, shifted to the left, prevents depression of the two flipper buttons 120 and 122 when the game is configured for air hockey.
Figure 31:
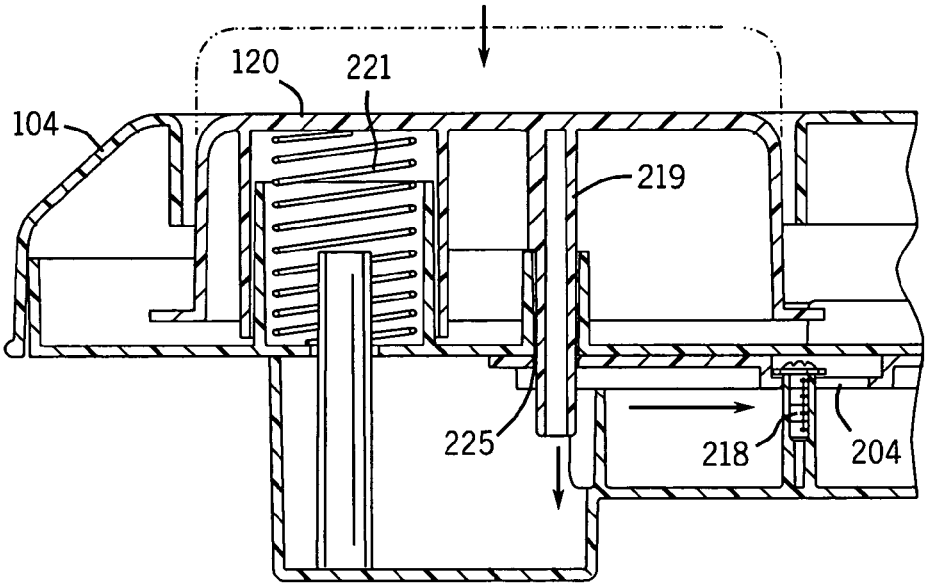
FIG. 31 is an enlarged, left side view of FIG. 29.
Figure 32:
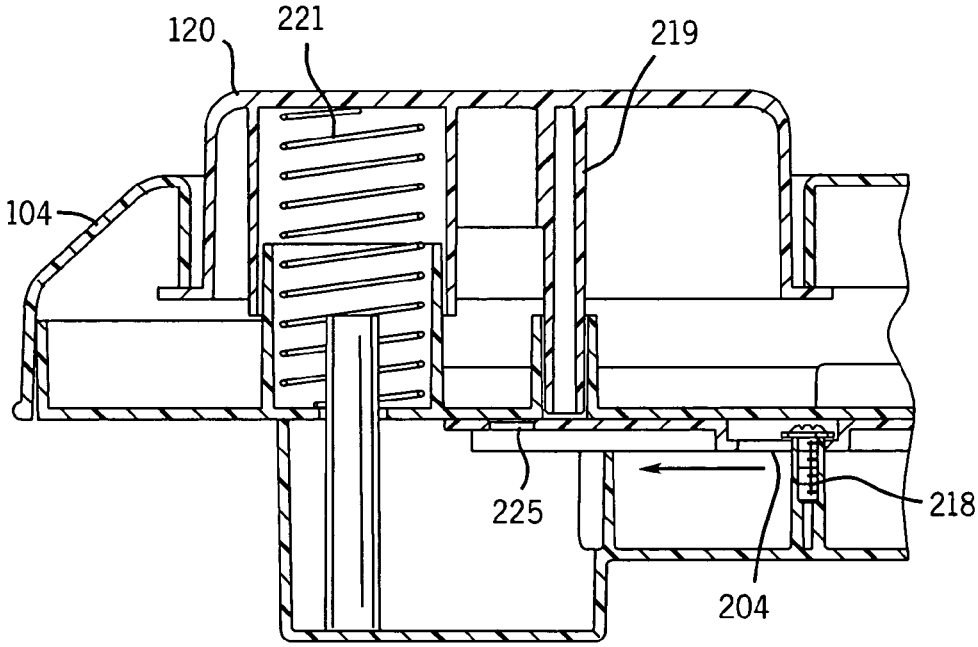
FIG. 32 is an enlarged, left side view of FIG. 30.

The details relating to how the slidable flipper button locking rod 200 locks and unlocks the flipper buttons 120 and 122 are best shown in the FIGS. 29 through 32 (FIGS. 12, 13, and 14 may also be helpful). As is shown best in FIG. 32, extending downwards from the two flipper buttons 120 and 122 are two cylindrical rods 217 and 219. The rods 217 and 219 are free to extend downward through holes 223 and 225 that penetrate the slidable flipper button locking rod 200 when the slidable rod 200 is slid to the right, as it is in FIG. 29 (and also in FIG. 31 and in FIGS. 12 and 14), for the air pinball game configuration. The flipper buttons 120 and 122 are thus free for the player to depress. In FIGS. 30 and 32, the flipper button 122 is shown not depressed, and the flipper button 120 is shown in its depressed state. When a player uses the mechanical slide switch 168 to slide the slidable flipper button locking rod 200 to the left in preparation for an air hockey game, as in FIGS. 30 and 32 and in FIG. 13, the holes 223 and 225 in the slidable rod 200 no longer line up with the rods 217 and 219. Now the flipper buttons 120 and 122 can no longer be depressed, for the rods 217 and 219 are prevented from descending downwards by the slidable rod 200 which blocks their path of travel. The flippers 123 and 125 are thus locked during an air hockey game and may not interfere with game play.

The slidable rod 200 includes elongated holes 202 and 204 which engage screws 216 and 218 which together hold the slidable rod 200 in place and also define precisely its range of slidable motion, as is shown in FIGS. 12 to 14 and 29 to 32.

Electrical and Electronic Components of the Game

FIG. 33 presents a partly logical and partly schematic diagram of the electrical and electronic circuitry for the game 100.

A block labelled batteries and filter 304 (FIG. 33) represents four standard C or D cell batteries connected in series to provide power, with the negative end of the series of batteries being indicated by a negative ground potential symbol (downward pointing arrow) in the drawing. Three of the batteries connected in series provide +4.5 volts relative to ground for the electronic components, while all four batteries connected in series provide +6 volts relative to ground for the game 100's blower 160. The +4.5 volt power is passed through a standard R-C type power supply filter the output of which is labelled $V_{DD}$ in FIG. 33.

The microprocessor 302 is of the standard type that can power itself down completely, drawing almost no current from the power supply when it is powered down. Actuation of the pushbutton switch 128S (corresponding to the switch and light 128 shown in FIG. 1) grounds a pin on the microprocessor which brings it up and into operation. As shown in FIG. 33, the microprocessor 302 then can sense signals from all of the game 100's switches (all of which are shown in the upper-right of FIG. 33), and it can also turn on and off all of the game's light emitting diodes (all of which are shown in the upper-left of FIG. 33). The reference numbers of some of these elements appear in other drawing Figures, as FIG. 33 indicates.

The microprocessor 302, when ready to play a game, actuates a transistor switch 308 which supplies $V_{DD}$ power to a bus 310 and thus supplies power both to the motor and motor control 306 for the blower 162 as well as to the goal's red emitting LEDs 208 and 212 and to the goal's phototransistors 210 and 214 and their respective amplifier transistors 328 and 330.

The motor and motor control 306, briefly described, contains several amplifiers for the signal 310 which switch on and off a power transistor that, when powered on, connects the blower 162's motor across the source of +6 volts of DC. Inductors (not shown) in the wires leading to the motor prevent transients from reaching the logic elements, and capacitors to ground (not shown) also prevent RF interference from flowing to the logic elements from the speaker 312 leads.

When the slide switch 170 is positioned to the left to signal an air hockey game, the microprocessor 302 does not activate the LEDs 314, 316, 318, and 226 that supply yellow and green light to the four pinball buffers 130, 132, 134, and 136, and it ignores signal inputs from the four buffer switches 320, 322, 324, and 326. The microprocessor actuates the bus 210 and thus actuates the blower 162 (to pressurize the plenum chamber 206), the goal red emitting LEDs 208 and 212, and the goal light sensing phototransistors 210 and 214. Hence, the game 100 responds to goals by illuminating the red goal lights 124 and 126 and by supplying sounds to the speaker 312.

When the slide switch 170 is positioned to the right to signal an air pinball game, the microprocessor 302 actuates all of the switches and LEDs, signalling with sounds and lights and adding to the score whenever a bumper is hit (illuminating the hit bumper's LED) and signalling whenever the uphill, closed goal 108 is struck with sounds and light (generated through illumination of its red goal light 124). The microprocessor may ignore inputs from the phototransistor 210 that is associated with the downhill goal 110, or it may respond to an input from the phototransistor 210 by signalling whenever a "pinball" puck 117 passes through the downhill goal and leaves the pinball game by flashing that goal's red goal light 126 and, for example, subtracting a penalty amount from the score.

Game Programming

There are many different ways in which the two games (air hockey and air pinball) may actually be programmed through programming of the microprocessor 203. In this embodiment, the pushbutton switch and light 128 (FIGS. 1 and 33) functions both as an ON switch and also as a "change game" switch that permits one to cycle between several different games. The mechanical slide switch 168, which also drives the electrical slide switch 170, signals whether all the games are to be air hockey type games or pinball type games. For example:

When the slide switch 168 shifted to the LEFT:

All the games are air hockey games.

The flippers are locked.

The handle 152 sets the playing field to level and opens the goal 108,

The following games can be selected by pressing the switch 128:

5 point air hockey game
7 point air hockey game
10 point air hockey game
5 point air hockey game
(and so on)

When the slide switch 168 is shifted to the RIGHT:

All the games are pinball games.

The flippers are free to work.

The handle 152 tilts the playing field and closes off the goal 108.

The following games can be selected by depressing the switch 128:

Practice
One Player High Score Challenge
Two Player High Score Challenge
Follow Me
Practice
(and so on)

The microprocessor 302 is equipped with a speaker 312, so voice, music, and any desired sound may be added to any game to add to the fun of the game. Here is a description of the games listed above as implemented in one embodiment of the invention.

Air Hockey Games

A player starts a game by first setting the mechanical slide switch 168 and the handle 152 into positions that correspond to air hockey or to air pinball. Let us assume that the player selects air hockey.

The player next depresses the ON pushbutton switch and light 128 which flashes red to signal that the game 100 is starting up. Music corresponding to air hockey then starts playing and this music continues to play so long as the game 100 remains on and in air hockey configuration. However, the music gets softer whenever the game 100's voice speaks. The game will time out if there is no action for a certain amount of time.

The game 100 says: "Hockey." (Two second pause.) "Select a game to play."

Each press of the pushbutton switch and light 128 then causes the game 100 to say the name of the next game, as follows: "5 point game." "7 point game." "10 point game." "5 point game." "7 point game." (And so on.)

After the player selects a game, the game 100 waits two seconds and then says: "Are you ready to play?" (One second pause.) "Press the start button to begin." (Note: the "start" button is the pushbutton switch and light 128.)

If the player does not respond in 10 seconds, the game 100 says: "Players, are you still there?" (If there is no response in the following ten seconds, the game 100 shuts itself off.)

Once the player presses the start button, the microprocessor 302 applies power to the bus 210, thus starting the blower motor and enabling the goal red LEDs 208 and 212 and the goal phototransistors 210 and 214 to function. The bus 210 remains powered until the game is over. (This is also done for all the games described below.)

The game 100 then says: "Are you ready . . . " (One second pause.) "Get set . . . " (One second pause.) "Begin . . . !"

Now game play begins. Every time a goal is scored, the game adds a point to the score of the corresponding player. The game 100 thus keeps track of the score.

Whenever a goal is scored, that goal's red goal light flashes, and the game 100 says: "Goal . . . !" (Siren sound and crowd cheering noise.)

The game 100 then selects and speaks one of the following messages, selecting them randomly: "Now, that was good . . . !" (Or) "Now, that was great . . . !" (Or) "Now, that was fantastic . . . !" (Or) "Now, that was awesome . . . !" (Or) "Now that was amazing . . . !" (Or) "Now, that was from waaayyy back . . . !" (Two second pause.)

Next, the game 100 says one of the following phrases, selecting them randomly: "What a great play . . . !" (Or) "What a great game . . . ! (Or) "What a great match-up . . . !" (Or) "What a great shot . . . !" (Or) What a great contest . . . !"

The game 100 then announces the total score: "The score is player one _ points, player two _ point(s)." (Two second pause.) "Are you ready to continue . . . ?" (One second pause.) "Get set . . . " (One second pause.) "Begin . . . !" (and so on until the game is over.)

If, at any time, the game 100 receives no trigger inputs from the goals for three minutes, the game 100 asks: "Players, are you still there . . . ?" (One second pause.) "Press the start button to keep playing." (The start button 128 starts flashing.) (Ten second pause.) "Press the start button to keep playing." (Ten second pause.) "Players are you still there?" (One second pause.) "Press the start button to keep playing." (Ten second pause.) (Then the game 100 shuts down.)

When a player scores the final goal of a game, a buzzer sound is produced, followed by the following dialogue: (One second pause.) "And it's all over . . . !" (One second pause.) (Crowd cheer sound.) (One second pause.) "Player (one/two) wins . . . !" (Red light adjacent the winning player's goal flashes.) (One second pause.) "The score is—player (one/two),_, player (two/one),_." (Note: the winner's score is always announced first.) (Two second pause.)

The game 100 next speaks one or the other of the following two messages: "What a great game . . . !" (Or) "What a great match-up . . . !" (Three second pause.)

The following sequence is then repeated twice or until the pushbutton switch and light 128 is depressed: "Players, are you still there . . . ?" (Two second pause.) "Press the start button to play again." (Pushbutton switch and light 128 begins flashing.) (Ten second pause, and then the game shuts down.)

If the pushbutton switch and light 128 has not yet been depressed, then the game 100 shuts down.

During air hockey game play, after the elapse of every 15 seconds without a goal being scored, one of the following messages are selected at random and played: "What a great game . . . !" (Or) "What a great match-up . . . !" (Or) "These players are really good . . . !" (Or) "These players are really great . . . !" (Or) "These players are really fantastic . . . !" (Or) "These players are really awesome . . . !" (Or) "These players are really amazing . . . !" (Or) "Did you see that . . . !"

Air Pinball Games

The mechanical slide switch 168 is thrown to the right to set up the game 100 for air pinball games.

To start up the games, a player presses the pushbutton switch and light 128. The pinball music commences playing and plays continuously until the game 100 turns off or is put back into air hockey configuration by moving the slide switch 168 to the left. The volume of the music drops whenever the game speaks.

The game 100 says: "Pinball!" (Two second pause.) "Select a game to play . . . !"

Each press of the pushbutton switch and light 128 produces the play of one of the following game announcement message, in sequence: "Practice" "One player High Score Challenge." "Two player High Score Challenge." "Follow Me." "Practice." (And so on.)

When the player stops pressing the switch 128, the game 100 pauses for two seconds and starts the selected game, as described below.

Air Pinball Game—Practice Game

The air pinball game's practice game does not keep score. It simply announces the score that you just achieved each time the puck 117 hits a bumper 130, 132, 134, or 136 or strikes the barrier 158 at the rear of the goal 108. There is no penalty when the puck slides out of the rear goal 110, unlike during normal play.

The game 100 says: "Practice." (Two second pause.) "Are you ready to play?" (One second pause.) "Press the start button to begin." (Ten second pause.) "Press the start button to begin." (Ten second pause.) "Players, are you still there?" (After ten more seconds, the game switches off.)

Once the switch 128 is depressed, the game 100's microprocessor 302 powers up the bus 210 (which stays powered up for the remainder of practice) and says: "Are you ready . . . " (One second pause.) "Get set . . . " (One second pause.) "Begin . . . !"

Pinball practice then begins. The game 100 waits for the puck to hit one of the bumpers 130 to 136 or the goal 108. Then the game responds as follows:

In response to striking one of the two yellow bumpers 130 or 136, the game says: "25 points!!" (Generate 25 point score sound or music.)

In response to striking one of the two green bumpers 132 or 134, the game says: "50 points!!" (Generate 50 point score sound or music.)

In response to striking the goal 108, the game flashes the red goal light and says: "100 points!!" (Generate 100 point score sound or music.)

There is no time limit to practice, and the game 100 is not keeping track of score. If the game 100 receives no puck 117 hits for three minutes, it asks: "Player, are you still there?" (One second pause.) "Press the start button to keep playing." (Pushbutton switch and light 128 starts flashing.) (Ten second pause.) "Press the start button to keep playing." (Ten second pause.) "Player, are you still there?" (One second pause.) "Press the start button to keep playing." (Ten second pause.) (The game 100 then shuts down.)

Of course, once the pushbutton switch and light 128—the start button—is pressed or once a bumper 130 to 136 or the goal 108 is struck by the puck 117, the practice resumes.

Air Pinball Game—One Player High Score Challange Game

After this game is selected, the pinball music begins to play, and the game 100 announces: "One player high score challenge." (Two second pause.) "The high score is _points!!" (Two second pause.) "Are you ready to play?"

At this point, the game 100 executes the "Single Player Routine" (set forth below as a separate game subroutine).

If the high score stored in the microprocessor 302 has been beat, the game 100 plays a siren sound three times and, while the siren is sounding, it announces: "You set a new high score!" (One second pause.) "You've got skills!" (Three second pause.) "Press the start button to play again."

The pushbutton switch and light 128 commences to flash. If the pushbutton switch and light 128 is not depressed, then after a ten second delay the game 100 says: "Press the start button to play again." (Ten second delay.) "Player, are you still there?" (One second delay.) "Press the start button to keep playing." (Ten second delay.) (The game 100 then shuts down.)

If the switch 128 is depressed, the game 100 plays the game over from the beginning.

Air Pinball Game—Two Player High Score Challange Game

The play begins almost the same as in the one player air pinball game, except the game 100 announces: "Two player high score challenge" at the start of the game. The game 100 then announces: "Player 1."

At this point, the Single Player Routine (set forth below) is executed for Player 1.

After a three second pause, the game 100 announces: "Player 2."

At this point, the Single Player Routine (set forth below) is executed for Player 2.

After a two second pause, the game 100 announces: "And it's all over!" (One-half second pause.) (Crowd cheering sound.) (One second pause.) "Player (one/two) wins!" (One second pause.) "The score is—player (one/two)_, player (two/one)_." (Note: the Winner's Score is Always Announced First)

After a two second pause, the game 100 then says one of the following, selected randomly: "What a great game!" (Or) "What a great match-up!" (Three second pause.) "Press the start button to play again." (The pushbutton switch and light 128 begins to flash.)

The game then times out, as in the case of the single player game, if the pushbutton switch and light 128 is not depressed.

Air Pinball Game—Follow Me Game

This game also begins almost the same as the one player game. The only change is that the game 100 announces: "Follow me" at the start of this game.

The game 100 randomly selects one of the five LEDs within the buffers 130, 132, 134, and 136 or within the goal light 124 (these are the five LEDs 124, 314, 316, 318, or 226 in FIG. 33).

The selected LED begins to flash, and the game 100 says: "Hit the flashing target!" (Two second pause.) "Are you ready . . . ?" (One second pause.) Begin . . . !"

If the puck 117 hits the goal 108 or a bumper 130 to 136 that is not flashing, the game 100 responds with one of the following messages: "Nice try!" (Or) "That was close!" (Or) "Almost!"

If the bumper or the goal associated with the flashing light is struck, the game 100 says one of the following messages, selected randomly: "Now, that was good . . . !" (Or) "Now, that was great . . . !" (Or) "Now, that was fantastic . . . !" (Or) "Now, that was awesome . . . !" (Or) "Now, that was amazing . . . !"

After a two-second pause, the game 100 randomly selects a different one of the five lights to flash, and the game then continues as above.

The game shuts itself off when it receives no input from any bumper switch or goal during two minutes.

Air Pinball Game—Single Player Routine

After a one second pause, the game 100 says: "Press the start button to begin." (Pushbutton switch and light 128 starts to flash.) (Ten second pause.) "Press the start button to begin." (Ten second pause.) "Players, are you still there?" (Ten second pause.) (Game 100 shuts down.)

Once the pushbutton switch and light 128 is depressed, the game 100 powers up the bus 210 and says: "Are you ready?" (One second pause.) "Get set . . . " (One second pause.) "Begin!"

Game play now begins. There is a 45 second time limit on this game, and score is kept.

In response to striking one of the two yellow bumpers 130 or 136, the game says: "25 points!!" (Generate 25 point sound or music.)

In response to striking one of the two green bumpers 132 or 134, the game says: "50 points!!" (Generate 50 point sound or music.)

In response to striking the goal 108, the game flashes the red goal light and says: "100 points!!" (Generate 100 point sound or music.) The game 100 then randomly selects and says one of the following: "Now, that was good!" (Or) "Now, that was great!" (Or) "Now, that was fantastic!" (Or) "Now, that was awesome!" (Or) "Now, that was fantastic!" (Or) "Now, that was amazing!"

If the puck 117 happens to slide out of the goal 110 at the lowest end of the game 100 (between the two flippers 121 and 123), the buzzer sound is played, and the game 100 announces: "Oh, Oh! Minus 25 points!" (25 points is subtracted from the player's score.)

When ten seconds remains in this 45-second game, a siren sound is produced, and the game 100 calls out: "Time's running out!"

After the 45 second time interval expires, the game 100 produces a buzzer sound and then says: "And it's all over!" (Two second pause.)

The game 100 then says one of the following: "Now, that was good!" (Or) "Now, that was great!" (Or) "Now, that was fantastic!" (Or) "Now, that was awesome!" (Or) "Now, that was fantastic!" (Or) "Now, that was amazing!"

After a two second pause, the game says: "Your score is _points!!"

Although just a single embodiment of the invention has been described, it should be understood that the invention is not limited to this precise embodiment, and that various changes and modifications may be made without departing from the scope or spirit of the invention as set forth in the claims annexed to and forming a part of this specification. For example, the disclosed embodiment teaches how a reconfigurable air hockey table game can be reconfigured into an air pinball game. Alternatively, an air hockey game can be reconfigured into an air bowling game or into a game where a puck is slid towards one or multiple goals that capture the puck and grant a score, or into other types and varieties of sliding puck games. Some alternative games may involve altering the tilt of the table while others may not. Some alternative games may involve blocking one of the goals while others may not. Some alternative games may involve adding bumpers along the edges or in the center of the playing field, while others may involve adding additional goals or additional sensors of some other type to the center or edges of the playing field. Some alternative games may add flippers, while others may not or may add some other mechanism whereby a player may add motional energy to the puck during play.

What is claimed is:

1. A reconfigurable air table hockey game including at least one air puck and designed to be set upon a flat, horizontal surface comprising:

a perforated, bounded playing surface overlying a plenum chamber supplied with air under pressure at least during game play;

a score keeping mechanism receiving signals indicative of scoring events;

goals for air hockey game play attached to and positioned at opposite ends of the playing surface to accept an air puck and to signal to the score keeping mechanism with the passage of an air puck through one of the goals; and an actuatable control that, when actuated, reconfigures the playing surface for at least one game other than air hockey game play, wherein the actuatable control alters the tilt of the playing surface relative to any flat, horizontal surface upon which the game is set thereby causing the air pucks to slide preferentially toward one end of the playing surface, and wherein the actuatable control further alters at least one of the goals causing the altered goal to reflect, rather than to accept, an air puck, the altered goal being positioned at the high end of the playing surface when it is tilted.

2. A reconfigurable air table hockey game in accordance with claim 1 wherein the actuatable control further enables flippers to strike at an air puck, the flippers being mounted adjacent the playing surface at the low end of the playing surface when it is tilted.

3. A reconfigurable air hockey game in accordance with claim 2 wherein the actuatable control further activates bumpers on or adjacent to the playing surface at least some of which bumpers then commence to signal to the score keeping mechanism when pucks are reflected by the bumpers.

4. A reconfigurable air hockey game in accordance with claim 1 wherein the actuatable control further activates bumpers on or adjacent to the playing surface and mounted near the altered goal, at least some of which bumpers then commence to signal to the score keeping mechanism when pucks are reflected by the bumpers.

5. A reconfigurable air table hockey game in accordance with claim 4 wherein the actuatable control further enables flippers to strike at an air puck, the flippers being mounted adjacent the playing surface at the low end of the playing surface when it is tilted.

6. A reconfigurable air table hockey game including at least one air puck and designed to be set upon a flat, horizontal surface comprising:

a perforated, bounded playing surface overlying a plenum chamber supplied with air under pressure at least during game play;

a score keeping mechanism receiving signals indicative of scoring events;

goals for air hockey game play attached to and positioned at opposite ends of the playing surface to accept an air puck and to signal to the score keeping mechanism with the passage of an air puck through one of the goals; and an actuatable control that when actuated, reconfigures the playing surface for at least one game other than air hockey game play, wherein the actuatable control activates bumpers on or adjacent to the playing surface at least some of which bumpers then commence to signal to the score keeping mechanism when pucks are reflected by the bumpers.

7. A reconfigurable air table hockey game in accordance with claim 6 wherein the actuatable control alters the tilt of the playing surface relative to any flat, horizontal surface upon which the game is set thereby causing the air pucks to slide preferentially toward one end of the playing surface, and wherein the actuatable control further enables flippers to strike at an air puck, the flippers being mounted adjacent the playing surface at the low end of the playing surface when it is tilted.

8. A reconfigurable air table hockey game in accordance with claim 6 wherein the actuatable control further enables flippers to strike at an air puck, the flippers being mounted adjacent the playing surface at the low end of the playing surface when it is tilted.

9. A method of reconfiguring an air table hockey game that includes at least one air puck, that is designed to be set upon a flat, horizontal surface that includes a perforated, bounded playing surface overlaying a plenum chamber supplied with air under pressure at least during game play, that includes a score keeping mechanism receiving signals indicative of scoring events, and that includes goals for air hockey game play attached to and positioned at opposite ends of the playing surface to accept an air puck and to signal to the score keeping mechanism the passage of an air puck through a goal the method comprising:

altering the tilt of the playing surface relative to any flat, horizontal surface upon which the game is set, thereby causing the air pucks to slide preferentially toward one end of the playing surface; and altering at least one of the goals to cause the altered goal to reflect, rather than to accept, an air puck, the altered goal being a goal that is positioned at the high end of the playing surface when it is tilted.

10. A method for reconfiguring an air table hockey game in accordance with claim 9 that also includes normally disabled flippers mounted adjacent the playing surface at the low end of that surface when it is tilted, the method of reconfiguring further comprising:

enabling the flippers so that they can strike at an air puck.

11. A method for reconfiguring an air table hockey game in accordance with claim 10 that also includes deactivated bumpers on or adjacent to the playing surface, the method of reconfiguring further comprising:

activating the bumpers to cause at least some of the bumpers to commence to signal to the score keeping mechanism when pucks are reflected by the bumpers.

12. A reconfigurable air table hockey game including at least one air puck and designed to be set upon a flat, horizontal surface comprising:

a perforated, bounded playing surface overlying a plenum chamber supplied with air under pressure at least during game play;

a score keeping mechanism receiving signals indicative of scoring events;

goals for air hockey game play attached to and positioned at opposite ends of the playing surface to accept an air puck and to signal to the score keeping mechanism with the passage of an air puck through one of the goals; and an actuatable control that, when actuated, reconfigures the playing surface with a plurality of functions performed by an actuatable control, including altering at least one of the goals and activating bumpers on or adjacent to the playing surface, some of which bumpers then commence to signal to the score keeping mechanism when pucks are reflected by the bumpers.

13. A reconfigurable air table hockey game in accordance with claim 12 wherein the actuatable control further enables flippers to strike at an air puck, the flippers being mounted adjacent the playing surface.

14. A reconfigurable air table hockey game in accordance with claim 12 wherein the actuatable control alters the tilt of the playing surface relative to any flat, horizontal surface upon which the game is set thereby causing the air pucks to slide preferentially toward one end of the playing surface.

15. A reconfigurable air table hockey game in accordance with claim 12 wherein the actuatable control reconfigures the playing surface for at least one game other than air hockey game play.

16. A reconfigurable air table hockey game in accordance with claim 14 wherein the actuatable control further alters at least one of the goals causing the altered goal to reflect, rather than to accept, an air puck, the altered goal being positioned at the high end of the playing surface when it is tilted.

17. A reconfigurable air table hockey game in accordance with claim 16 wherein the actuatable control further enables flippers to strike at an air puck, the flippers being mounted adjacent the playing surface at the low end of the playing surface when it is tilted.

18. A reconfigurable air hockey game in accordance with claim 17 wherein the actuatable control further activates bumpers on or adjacent to the playing surface at least some of which bumpers then commence to signal to the score keeping mechanism when pucks are reflected by the bumpers.

19. A reconfigurable air hockey game in accordance with claim 16 wherein the actuatable control further activates bumpers on or adjacent to the playing surface and mounted near the altered goal, at least some of which bumpers then commence to signal to the score keeping mechanism when pucks are reflected by the bumpers.

20. A reconfigurable air table hockey game in accordance with claim 19 wherein the actuatable control further enables flippers to strike at an air puck, the flippers being mounted adjacent the playing surface at the low end of the playing surface when it is tilted.

* * * * *